US005457019A

United States Patent [19]

Nozawa et al.

[11] Patent Number: 5,457,019

[45] Date of Patent: Oct. 10, 1995

[54] METHOD OF STORING A SILVER HALIDE PHOTOGRAPHIC EMULSION, SILVER HALIDE PHOTOGRAPHIC EMULSION, AND SILVER HALIDE LIGHT-SENSITIVE MATERIAL

[75] Inventors: Yasushi Nozawa; Mitsuhiro Uchida, both of Minami-Ashigara, Japan

[73] Assignee: Fuji Photo Film Co., Ltd., Kanagawa, Japan

[21] Appl. No.: 184,437

[22] Filed: Jan. 21, 1994

[30] Foreign Application Priority Data

Jan. 22, 1993 [JP] Japan ..... 5-026031

[51] Int. Cl.[6] ..... G03C 1/34

[52] U.S. Cl. ..... 430/551; 430/567; 430/607; 430/611; 430/600; 430/372

[58] Field of Search ..... 430/567, 607, 430/611, 600, 551, 372

[56] References Cited

U.S. PATENT DOCUMENTS

| | | | |
|---|---|---|---|
| 5,132,202 | 7/1992 | Nishijima et al. | 430/551 |
| 5,212,055 | 5/1993 | Morigaki et al. | 430/551 |

OTHER PUBLICATIONS

Reseach Disclosure, vol. 308, Item 308119, Dec., 1989.

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A silver halid photographic emulsion contains an antioxidizing agent.

12 Claims, No Drawings

METHOD OF STORING A SILVER HALIDE PHOTOGRAPHIC EMULSION, SILVER HALIDE PHOTOGRAPHIC EMULSION, AND SILVER HALIDE LIGHT-SENSITIVE MATERIAL

BACKGROUND OF THE INVENTION

1. Field of the Invention

The present invention relates to a method of storing a silver halide photographic emulsion, silver halide photographic emulsion, and a silver halide light-sensitive material, and more specifically to a storing method which can lower the deterioration of performance during the storage after preparation of a silver halide photographic emulsion having a high sensitivity and an excellent graininess.

2. Description of the Related Art

A silver halide photographic emulsion is prepared through steps including formation of grains, desalting, and chemical sensitization. If necessary, an additive, a coupler dispersion or the like is added to the silver halide emulsion after preparation thereof. The emulsion is applied on a support, and dried. The obtained material is cut into pieces each having a predetermined size, and packaged.

After the preparation of the silver halide photographic light-sensitive emulsion, the emulsion may be coated on a substrate immediately, or, if necessary, the emulsion prepared may be stored for a certain period of time in the state of sol or gel before application. Due to the restrictions placed on the preparing apparatus and method, the emulsion is usually stored for a certain period of time after preparation.

During the storage, photographic properties or performances (for example, sensitivity and fogging) are likely to change. The change of the properties should be suppressed to as small a level as possible. For this reason, it is generally considered that a prepared silver halide photographic emulsion should be stored at a low temperature of, for example, 5° C. so as to suppress the change with time as effectively as possible.

Researches has been conducted for suppressing the change with time. For example, Research Disclosures Nos. 10152 and 13941 disclose a method of storing a silver halide photographic emulsion in a freeze-dried state. However, such a method involves a severe restriction in terms of production facilities, and has the drawback in which fogging increases at the moment of freeze-drying with a high-sensitivity emulsion.

British Patent 1,159,385 and JP-A-1-287672 disclose a method of improving the storage stability by storing an emulsion in a deoxygenated state created by nitrogen substitution. Although such a method is certainly effective and useful, the method involves a severe restriction in production facilities, and a drawback of its effect being insufficient, probably due to the fact that it is substantially impossible to completely shut off oxygen. Therefore, there has been a demand for improvement of the method.

SUMMARY OF THE INVENTION

An object of the present invention is to provide a method of storing a silver halide photographic emulsion after preparation thereof, by which the deterioration of the properties during the storage is very low. Another object is to provide a silver halide photographic emulsion and a silver halide light-sensitive material in which the deterioration of their photographic performances are greatly suppressed during storage.

Still another object is to provide a storing method involving a less restriction in terms of facilities.

The inventors of the present invention have conducted research, and discovered that these objects of the present invention can be achieved by a method of storing a silver halide photographic emulsion, comprising storing the emulsion in the presence of at least one antioxidizing agent added thereto.

Preferably the antioxidizing agent is represented by formula (A) below:

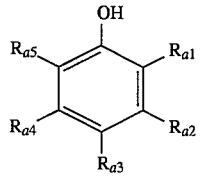

Formula (A)

where $R_{al}$ to $R_{a5}$ may be the same or different, and each represents a hydrogen atom, an alkyl group, an alkenyl group, an aryl group, a heterocyclic group, an alkyloxycarbonyl group, an aryloxycarbonyl group, an acyl group, an alkylsulfonyl group, an arylsulfonyl group, a carboxyl group, a carbamoyl group, a sulfamoyl group, a halogen atom or —X—$R_{a0}$, —X— represents —O—, —S— or —N($R_{a6}$)—, $R_{a0}$ represents an alkyl group, an alkenyl group, an aryl group, a heterocyclic group, an acyl group, an alkylsufonyl group or an arylsulfonyl group, $R_{a6}$ represents a hydrogen atom or a group defined by $R_{a0}$, and those substituents $R_{a1}$–$R_{a5}$, which are located at an orthoposition with respect to each other, may be combined to form a 5- to 7-membered ring, with the proviso that $R_{a1}$ to $R_{a5}$ must not be hydrogen atoms all at the same time, and when $R_{a3}$ is a halogen atom, —0—$R_{a0}$, or —S—$R_{a0}$, at least one of $R_{a1}$ and $R_{a5}$ is an alkyl group.

The silver halide photographic emulsion of the invention may be reduction-sensitized.

In a preferred embodiment, the silver halide photographic emulsion consists of silver halide grains, at least 50% of which grains have a ratio of (100) face of 60% or more to the total face.

The silver halide photographic emulsion of the invention may be selenium-sensitized.

DETAILED DESCRIPTION OF THE PREFERRED EMBODIMENTS

The present invention will now be described in further detail.

During storage and after the preparation of the silver halide photographic emulsion, the properties or performances of the emulsion deteriorate. The change of the properties depends on the type of emulsion. As a typical example, the fogging and sensitivity gradually decrease during storage in some cases, while, in other cases, the fogging gradually increases during storage. In particular, as will be described later, emulsions which are reduction-sensitized so as to achieve fine-grain high sensitivity emulsions, those having a high ratio of (100) face, and emulsions which are selenium-sensitized exhibit, in many cases, a significant increase in fogging.

Methods disclosed in British Patent No. 1,159,385 and JP-A-1-287,672 for improving the storage stability by storing a prepared material in a deoxygenated state created by replacement with nitrogen, which have been proposed for the purpose of suppressing such change during storage as much as possible, were examined. These methods exhibited effects to a certain degree; however, the methods involve a severe limitation in terms of production facilities, and the exhibited effects were insufficient. The results of the examination suggested that oxygen had a great influence on the deterioration of properties of a silver halide photographic emulsion.

In consideration of the results, the inventor of the present invention conducted intensive research for substantially cutting off the influence of oxygen during storage, and achieved the present invention on the basis of the discovery that the deterioration of the properties during the storage could be lowered by adding an antioxidizing agent, particularly, a compound represented by the above formula (A) to the material.

Conventionally, it is known that an antioxidizing agent is added to a silver halide photographic material.

As one of the best-known examples, an antioxidizing agent is added in advance to a coupler dispersion for the purpose of improving the image storability after the development process of a silver halide color photographic light-sensitive material.

Further, JP-B-43-4133, JP-A-57-176032, JP-A-56-52734, JP-A-58-28714, JP-A-61-91651, British Patent 2,054,187, and U.S. Pat. Nos. 3,582,333, 3,671,248, 3,902,905 and 3,522,053, for example, disclose that an antioxidizing agent, or a compound which falls within the category of an antioxidizing agent, is added to the material in order for improvement of the development property of a light-sensitive material (which is not a silver halide photographic emulsion), suppression of the fogging, improvement of the gradation, improvement of the raw stock storability, or improvement of the latent image storability.

However, in the examples of these references the antioxidizing agent is mixed into a silver halide photographic emulsion immediately before coating, or the antioxidizing agent is added to an interlayer, or the timing of addition is specified.

The present invention is based on the fact that an antioxidizing agent, particularly, a compound represented by the formula (A), is effective for suppressing the deterioration of properties of a prepared silver halide photographic emulsion during storage, and is a novel invention since such a fact has not been known before the present invention. It is remarkable that the present invention exhibits a significant effect especially when combined with an emulsion which is reduction-sensitized, an emulsion having a high ratio of (100) face, or an emulsion which is selenium-sensitized.

Additives generally used for suppressing undesirable changes in foods, petroleum products or plastic products and the like, due to oxidization, may be used as antioxidizing agents applicable to the present invention. The antioxidizing agents are listed in, for example, "Handbook for Antioxidizing Agents" (Taisei Sha), or "Theory and Practice of Anti-oxidant" (Sanshuu Shoboh). More specifically, they are hydroquinones, catechols, phenols, gallic acids, ascorbic acid, sulfites, hydrogen sulfites, and tocopherols. Further such research revealed that the compounds represented by the formula (A), described later in detail, are most preferable.

Although the mechanism of the present invention is not completely clarified, it is presently considered that those compounds which have a reducing effect for substantially preventing oxygen from having an influence on silver halide, do not directly act on silver halide, and do not have a bad influence on silver halide, are most preferable. In this sense, as the researches of the present inventors revealed, the compounds represented by formula (A) including a certain types of phenols or tocopherols are most preferable, and an astorbic acid is also one of the preferable compounds.

The compounds represented by the formula (A) will be described specifically in detail. It should be noted here that the substituents described below may further include substituents.

In the formula (A), $R_{a1}$–$R_{a5}$ may be the same or different, and each represents a hydrogen atom, an alkyl group (for example, methyl, t-butyl, t-octyl, cyclohexyl, 2'-hydroxybenzyl, 4'-hydroxybenzyl, or carboxyethyl, preferably having 1–30 carbon atoms), an alkenyl group (for example, allyl or vinyl, preferably having 2–30 carbon atoms), an aryl group (for example, phenyl, 2-hydroxyphenyl or 4-hydroxyphenyl, preferably 1-piperidyl or 1-pyrrolidinyl, preferably a saturated heterocyclic ring having 4–15 carbon atoms), an alkyloxycarbonyl group (for example, ethoxycarbonyl or hexadecyloxycarbonyl), an aryloxycarbonyl group (for example, phenoxycarbonyl 2,4-di-t-butylphenoxycarbonyl), an acyl group (for example, acetyl, benzoyl or myristoyl), a sulfonyl group (preferably an alkylsulfonyl group, for example, methanesulfonyl, or an arylsulfonyl group, for example, benzenesulfonyl or 2-hydroxybenzenesulfonyl), a carboxyl group, a carbamoyl (for example, dimethylcarbamoyl, methylphenylcarbamoyl or dodecylcarbamoyl), a sulfamoyl group (for example, dimethylsulfamoyl or dodecylsulfamoyl), a halogen atom (for example, chlorine, bromine or fluorine) or —X—$R_{a0}$.

The group "—X—" represents —O—, —S— or —N($R_{a6}$)—. $R_{a0}$ represents an alkyl group (for example, methyl, isopropyl, octyl, benzyl, hexadecyl, methoxyethyl or cyclohexyl, preferably having 1–26 carbon atoms), an alkenyl group (for example, aryl or vinyl, preferably having 2–26 carbons), an aryl group (for example, phenyl, 4-methoxyphenyl, or naphthyl, preferably, phenyl or substituted phenyl having 6–30 carbon atoms), a heterocyclic group (for example, 2-tetrahydropyranyl or pyridyl), an acyl group (for example, acetyl, benzoyl or tetradecanoyl), or a sulfonyl group (preferably an alkylsulfonyl group, for example, methanesulfonyl or octanesulfonyl, or an arylsulfonyl group, for example, an alkylsulfonyl group, for example, methanesulfonyl or octanesulfonyl, or an arylsulfonyl group, for example, benzenesulfonyl). $R_{a6}$ represents a hydrogen atom or the groups defined by $R_{a0}$. Those groups $R_{a1}$–$R_{a5}$ which are located at an ortho position with respect to each other may be combined to form a 5- to 7-membered ring (for example, chroman ring or indan ring), or may form a spiro-ring or bicyclo-ring.

However, the substituents $R_{a1}$–$R_{a5}$ may not be all hydrogen atoms at the same time, and when $R_{a3}$ is a halogen atom, —O—$R_{a0}$ or —S—$R_{a0}$, at least one of $R_{a1}$ and $R_{a5}$ is an alkyl group.

Of the compounds represented by the general formula (A), those preferable in terms of the effect of the present invention will be listed below.

* Compounds having a substituent at the position of any one of $R_{a1}$, $R_{a3}$ and $R_{a5}$, and a hydrogen atom at the a position of at least one of the substituents.
* Compounds in which $R_{a1}$ is an alkyl group.
* Compounds in which $R_{a1}$ is an acylamino group.
* Compounds in which substituents $R_{a1}$–$R_{a5}$ which are located at an ortho position with respect to each other are combined to form a chroman ring, coumaran ring or indan ring.

Of the compounds represented by the formula (A), compounds preferable in terms of the effect of the present invention are those represented by formulas (A-I) and (A-II) set forth below, and most preferable ones are those represented by formula (A-II).

Formula (A-I)

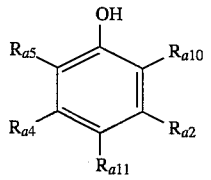

Formula (A-II)

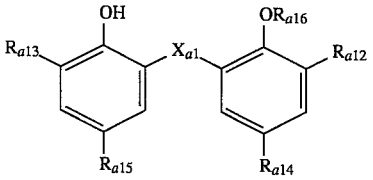

In the formula (A-I), $R_{a10}$ represents an alkyl group, and $R_{a11}$ represents an alkyl group, an alkoxy group or an aryloxy group. $R_{a2}$, $R_{a4}$ and $R_{a5}$ represent groups defined in the formula (A). Regarding the formula (A-I), those compounds in which each of $R_{a2}$, $R_{a4}$ and $R_{a5}$ is an hydrogen atom, an alkyl group or an alkoxy group are preferable in terms of the effect of the present invention.

Regarding the formula (A-I), those compounds in which $R_{a2}$ and $R_{a11}$ , $R_{a2}$ and $R_{a10}$ or $R_{a4}$ and $R_{a11}$ are combined to form an indan ring, coumaran ring, or chroman ring, or spiro-ring or bicyclo ring thereof, are also preferable.

In the formula (A-II), $R_{a12}$–$R_{a15}$ each represent an alkyl group, and $R_{a16}$ represents a hydrogen atom, an alkyl group, an alkenyl group, an aryl group, an acyl group, or a sulfonyl group. $X_{a1}$ represents a single bond, —O—, —S— or —CH($R_{a17}$)—, wherein $R_{a17}$ represents a hydrogen atom, an alkyl group or an aryl group. Regarding the formula (A-II), those compounds in which $R_{a16}$ is a hydrogen atom, or $X_{a1}$ is —CH($R_{a17}$)—, are preferable in terms of the effect of the present invention. Of these compounds, compounds in which $R_{a17}$ is a hydrogen atom or an alkyl group (preferably having 1–11 carbon atoms) are particularly preferable.

Specific examples of the compound represented by the formula (A) of the present invention will be listed below; however the compounds applicable to the present invention are not limited to those.

(A-1)

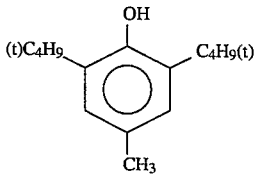

(A-2)

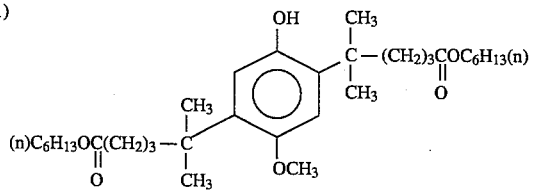

(A-3)

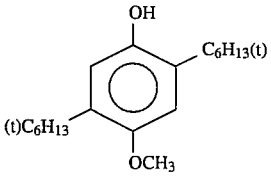

(A-4)

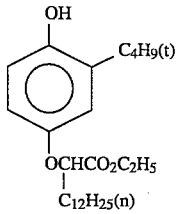

(A-5)

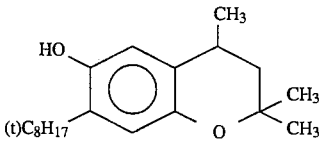

(A-6)

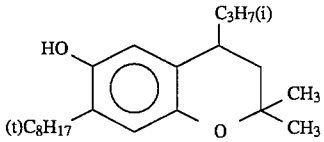

(A-7)

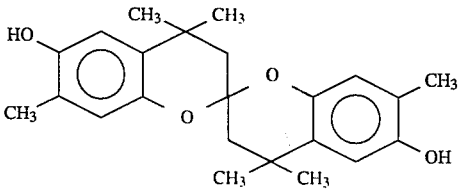

(A-8)

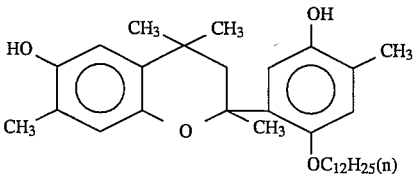

(A-9)

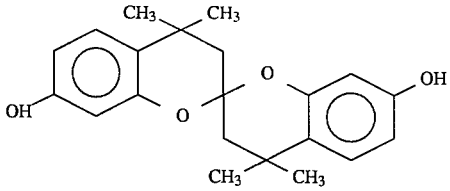

(A-14)

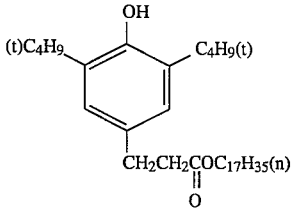

-continued
(A-15)
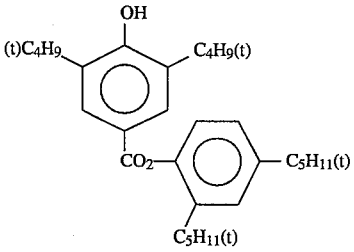
(A-16)
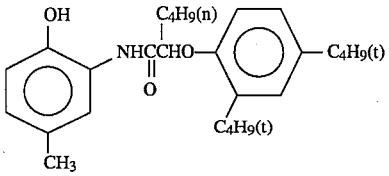
(A-17)
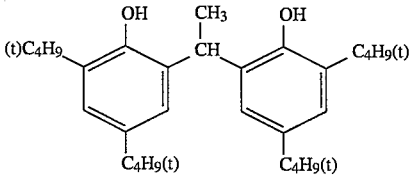
(A-18)
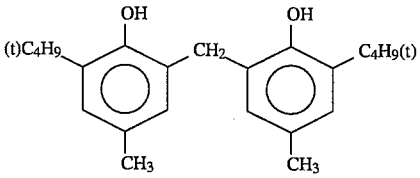
(A-19)
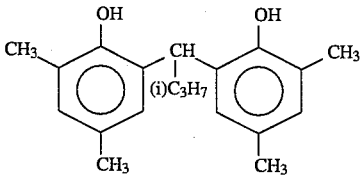
(A-20)
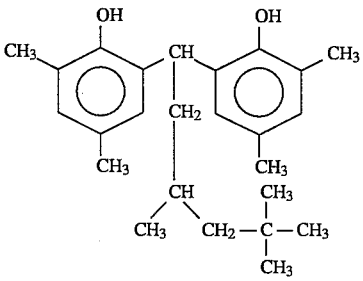
(A-21)
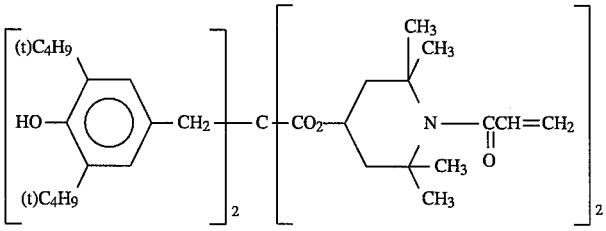
(A-22)
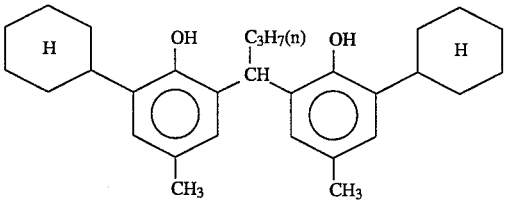
(A-23)
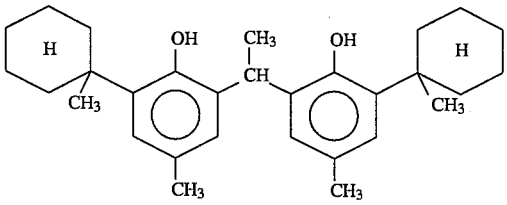
(A-24)
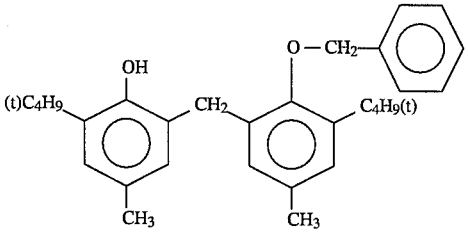
(A-25)
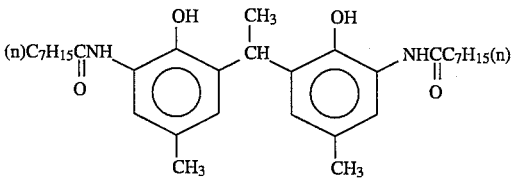
(A-26)
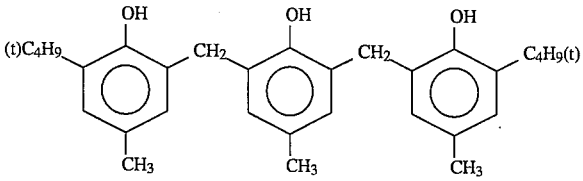

-continued
(A-27)
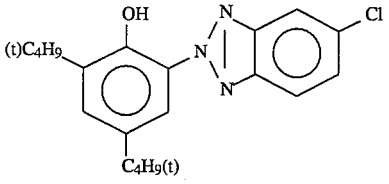
(A-28)
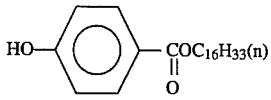
(A-29)
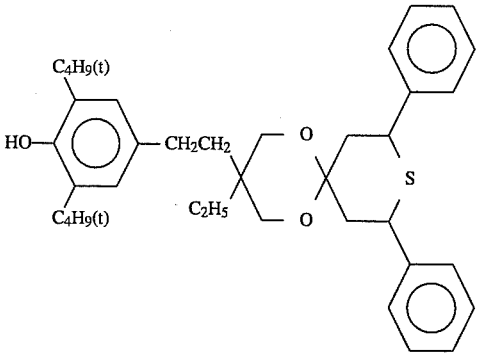
(A-30)
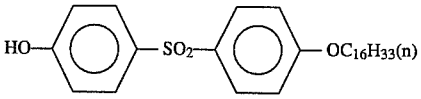
(A-31)
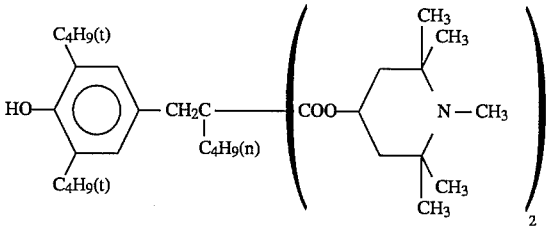
(A-32)
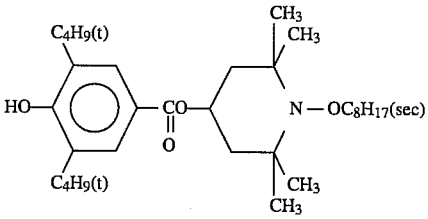
(A-33)
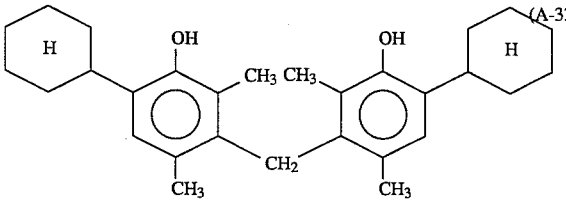
(A-34)
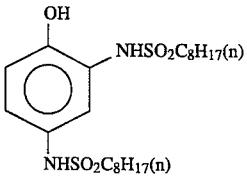
(A-35)
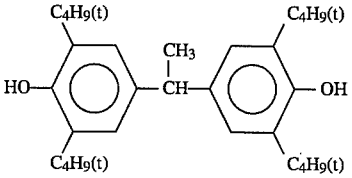
(A-36)
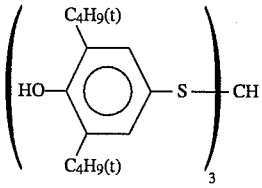
(A-37)
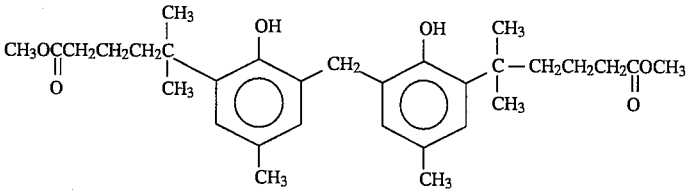
(A-38)
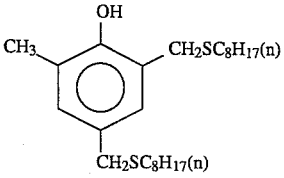
(A-39)
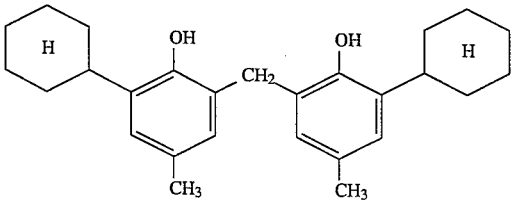

-continued
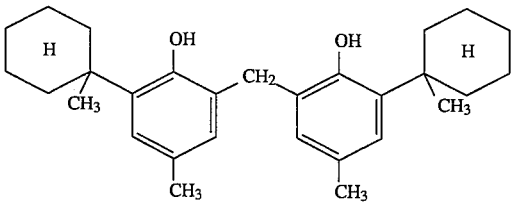
(A-40)
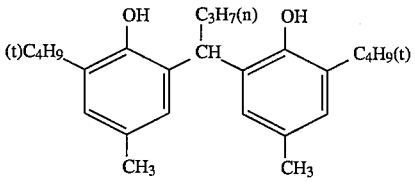
(A-41)
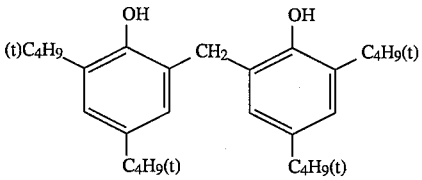
(A-42)
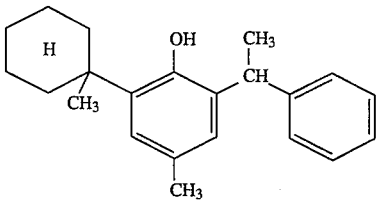
(A-43)
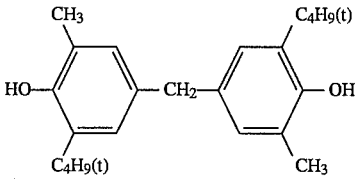
(A-44)
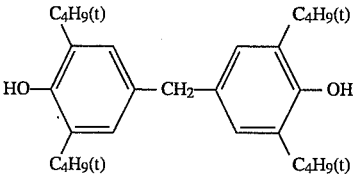
(A-45)
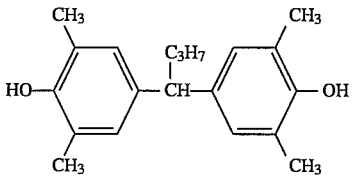
(A-46)
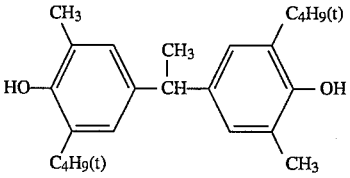
(A-47)
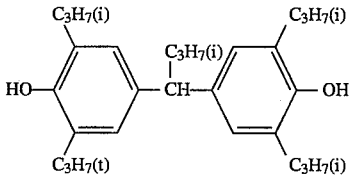
(A-48)
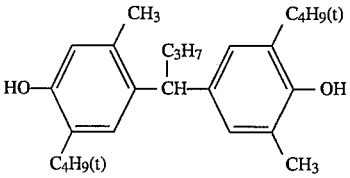
(A-49)
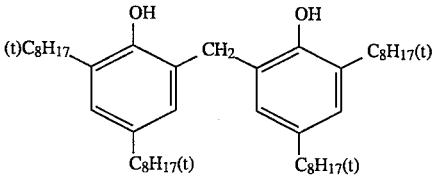
(A-50)
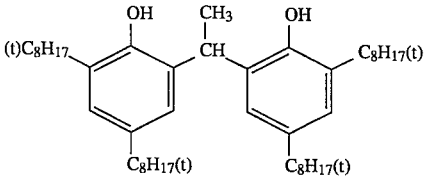
(A-51)
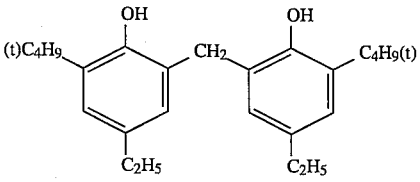
(A-52)
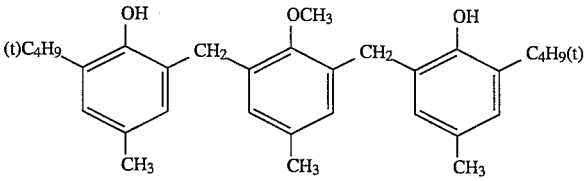
(A-53)

-continued
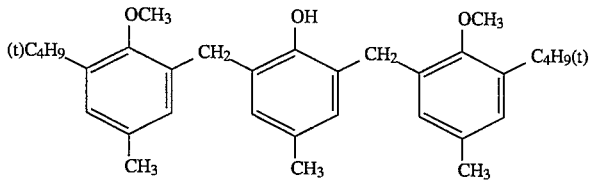
(A-54)
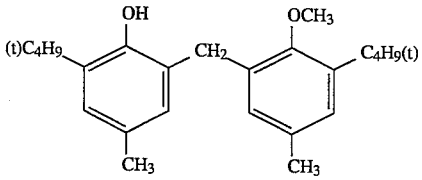
(A-55)
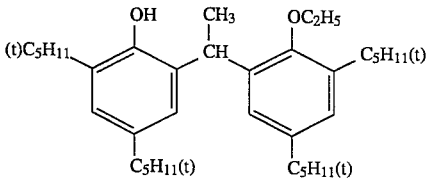
(A-56)
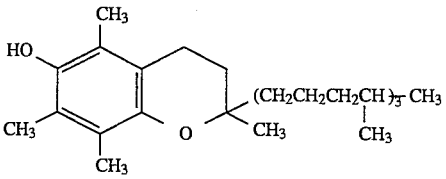
(A-57)
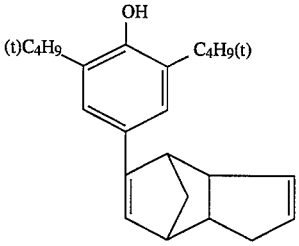
(A-58)
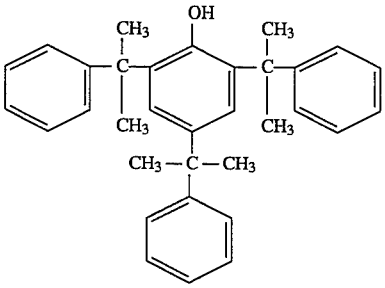
(A-59)
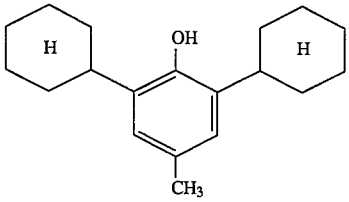
(A-60)
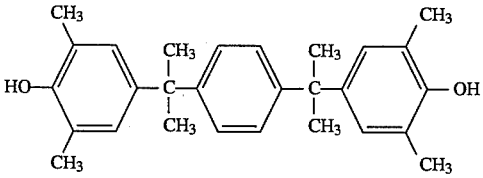
(A-61)
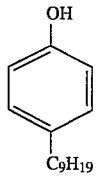
(A-62)
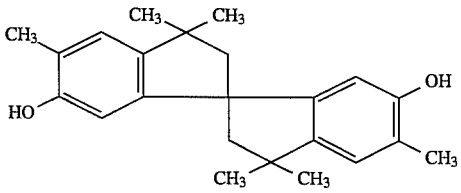
(A-63)
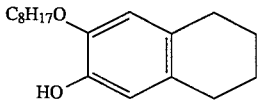
(A-64)
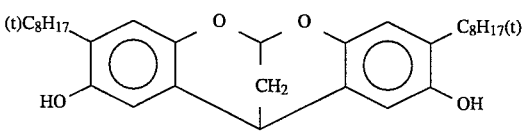
(A-65)
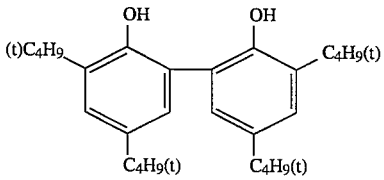
(A-66)

-continued (A-67)

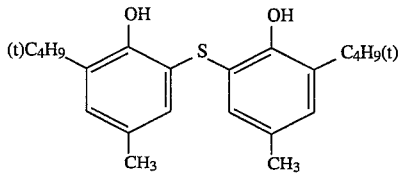

(A-68)

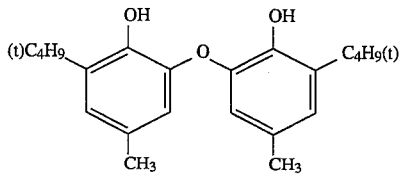

(A-69)

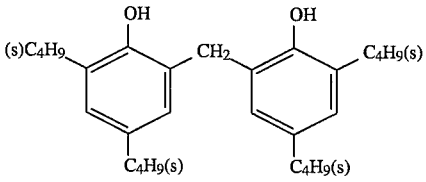

(A-70)

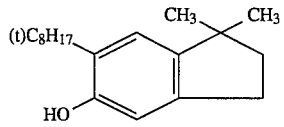

(A-71)

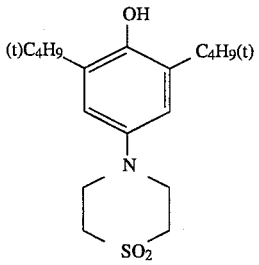

(A-72)

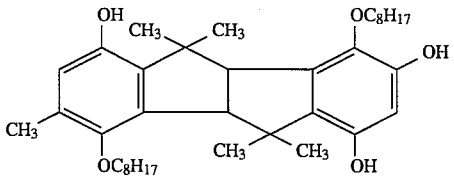

(A-73)

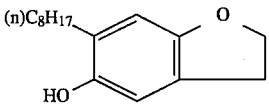

(A-74)

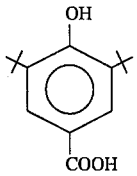

(A-75)

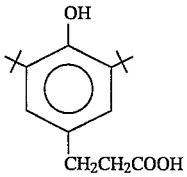

(A-76)

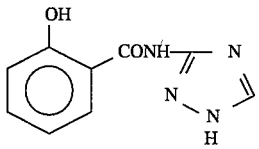

Other examples of the preferable compound represented by the formula (A) of the present invention, and methods of synthesizing such compounds are disclosed in, for example, U.S. Pat. Nos. 3,432,300, 3,573,050, 3,574,627, 3,700,455, 3,764,337, 3,939,866, 4,113,495, 4,120,723, 4,268,593, 4,430,425, 4,745,050, 2,043,931, European Patent 176,845, JP-B-48-31256, JP-B-54-12055, JP-A-1-137258, and JP-A-1-137254.

The compound may be added after being dissolved in water, alcohol, ester or a ketone, or a solvent mixture thereof.

The amount of the compound represented by formula (A) of the present invention is preferably in a range of $1\times10^{-6}$ to $1\times10^{-2}$ moles, more preferably $1\times10^{-5}$ to $1\times10^{-3}$ moles, most preferably $5\times10^{-5}$ to $1\times10^{-3}$ moles per mole of silver halide contained in a layer or an emulsion to which the compound is to be added.

The inventors of the present invention have conducted intensive researches on reduction sensitization in order to achieve a fine-grain high sensitization. However, it was found that the deterioration of properties of the silver halide photographic emulsions during storage was significant particularly in those reduction-sensitized emulsions and fog was remarkably increased in the reduction-sensitized emulsions. As a result, improvement of the properties was required.

It was further found that the technique of improving the properties by adding an antioxidizing agent of the present invention, in particular, a compound represented by formula (A), exhibited a particularly significant effect for emulsions subjected to reduction-sensitization.

The reduction sensitization will be described.

The preparation process of the silver halide photographic emulsion can be categorized mainly into grain formation, desalting, and chemical sensitization. The grain formation can be further divided into substeps, i.e., nucleation, ripening and growth. These steps do not usually proceed regularly, but the order of the steps may be reversed, or some steps may be repeated. Basically, the reduction sensitization may be carried out in any of the steps, and further may be performed at the nucleation, which is the initiation step of the grain formation, at the physical ripening, or at the growth, or prior or posterior to the chemical sensitization. When the chemical sensitization co-using gold-sensitization is performed, the reduction sensitization is preferably carried out prior to the chemical sensitization so as to prevent undesirable fogging. In particular, it is most preferable that the reduction sensitization be carried out during the growth of silver halide grains. Such a method carried out during the growth includes the technique in which the reduction sensitization is carried out while silver halide grains being grown during the physical ripening or the addition of a water-soluble silver salt and a water-soluble alkali halide, and the technique in which the reduction sensitization is carried out while the growth of the grains is paused, and thereafter, the grains are further grown.

For the reduction sensitization of the present invention, any of the following methods may be selected, i.e., the method of adding a known reducing agent to a silver halide photographic emulsion, a so-called silver ripening method, in which grains are grown or ripened in an enviroment of a low pAg of 1–7, and a so-called high pH ripening method, in which grains are grown or ripened in an enviroment of a high pH of 8–11. Two or more methods may be used in combination.

The addition of a reduction sensitizing agent is preferable since the level of the reduction sensitization can be finely adjusted.

Examples of the known reduction sensitizing agent are stannous salts, amines, polyamines, hydrazine derivatives, formamidinesulfinic acids, silane compounds, borane compounds, ascorbic acids, and derivatives thereof. For the present invention, any of these known compounds may be used, or two or more compounds may be used in combination. The compounds preferable as the reduction sensitizing agent are stannous chloride, thiourea dioxide, dimethylamineborane, ascorbic acid, and derivatives thereof. The amount of addition of the reduction sensitizing agent depends upon the emulsion preparation conditions, but is usually within a range of $10^{-7}$ to $10^{-1}$ mole per mole of silver halide.

The reduction sensitizing agent may be added during the formation of grains, before or after the chemical sensitization, or after dissolved into a solvent such as an alcohol, a glycol, a ketone, an ester, or an amide. It may be added in any step of the preparation of the emulsion, but it is particularly preferable to be added during the growth of the grains. The agent may be added in advance to the reaction vessel; however, it is preferable to add it at an appropriate time during the formation of grains. Or the reduction sensitizing agent may be added in advance in a solution of silver salt or alkali halide, and grains may be formed by use of such a solution. Further, it is preferable for the solution of the reduction sensitizing agent to be added sequentially while the grains are being formed, or continuously over a long period of time.

In view of fogging and storability, the reduction sensitization is preferably carried out within a grain of silver halide so as not to create a great number of reduction-sensitizing nuclei near the surface of the silver halide grain.

Specifically, the inner-grain reduction sensitization can be achieved by performing the reduction sensitization during the growth of silver halide grains as mentioned before. For the purpose of not having a great number of reduction sensitization nuclei near the surface of each silver halide grain, the following techniques are proposed.

1. The reduction sensitization should not be carried out in the last half of the growth of silver halide grains.

2. After the completion of formation of grains, the treatment for reducing the number of reaction-sensitizing nuclei located near the surface, or preferably, removing all of them, is performed. Preferably, the grain surface is treated with an oxidizing agent for silver.

More specifically, in order to achieve the above item 1, the reduction sensitizing agent should be completely used up in the middle of the formation of the grains, that portion of the reduction sensitizing agent which is still remaining in the middle of the formation of the grains should be deactivated by means of an oxidization treatment or the like, that portion of the reduction sensitizing agent which is substantially remaining should be deactivated by creating a high pAg, or a low pH environment in the last half of the grain formation, or in the case of the silver ripening or high pH ripening, the last half of the formation of grains is carried out in a high pHg or low pH environment.

In order to achieve the above item 2, a high pAg or low pH ripening method, a ripening method with the addition of an oxidizing agent for silver, and the like are effective. A known oxidizing agent can be used as the oxidizing agent for silver.

Of the methods set forth in the above item 2, the oxidization treatment of the grain surface is preferably selected.

A particularly preferable technique is to add at least one of compounds represented by the following formulas (XI) to (XIII). These compounds are effective also for oxidizing a reduction-sensitized nucleus after the grain formation. It is remarkable despite the addition of these compounds in the middle of the growth of grains to be reduction-sensitized, an excellent reduction sensitization may be achieved while maintaining good properties of fogging and storability, if the conditions are appropriately set.

(XI) $R\text{-}SO_2S\text{-}M$ (XII) $R\text{-}SO_2S\text{-}R^1$ (XIII) $R\text{-}SO_2S\text{-}L_m\text{-}SSO_2\text{-}R^2$ In these formulas, R, $R^1$ and $R^2$ may be the same or different and each represents an aliphatic group, an aromatic group or a heterocyclic group, and M represents a cation. L represents a divalent linking group, and m is either 0 or 1. The compounds represented by formulas (XI) to (XIII) may be polymers each containing, as a repeating unit, a divalent group derived from a structure represented by any of the formulas (XI) to (XIII). If possible, R, $R^1$, $R^2$ and L may be combined to form a ring.

The thiosulfonic acid compounds represented by the formula (XI), (XII) or (XIII) will be described in further detail. When R, $R^1$ and $R^2$ are aliphatic groups, each of them is a saturated or unsaturated, straightchain, branched or cyclic aliphatic hydrocarbon group, preferably an alkynyl group having 1–22 carbon atoms, or an alkenyl or alkynyl group having 2–22 carbon atoms, and each group may have a substituent. Examples of the alkyl group are methyl, ethyl, propyl, butyl, pentyl, hexyl, octyl, 2-ethylhexyl, decyl, dodecyl, hexadecyl, octadecyl, cyclohexyl, isopropyl and t-butyl.

Examples of the alkenyl group are allyl and butenyl.

Examples of the alkynyl group are propargyl and butynyl.

When R, $R^1$ and $R^2$ are aromatic groups, each of them may be a single-ring or fused-ring aromatic group, preferably having 6–20 carbon atoms, for example, phenyl or naphthyl, and may be substituted.

When R, $R^1$ and $R^2$ are heterocyclic groups, each of them is a 3- to 15-membered, preferably 3- to 6-membered ring which contains at least one element selected from the group consisting of nitrogen, oxygen, sulfur, selenium and tellurium, and contains at least one carbon atom. Examples of the heterocyclic group are pyrolidine, piperidine, pyridine, tetrahydrofurane, thiophene, oxazole, thiazole, imidazole, benzothiazole, benzoxazole, benzimidazole, selenazole, benzoselenazole, tellurazole, triazole, benzotriazole, tetrazole, oxadiazole, and thiadiazole rings.

Examples of the substituent group of R, $R^1$ and $R^2$ are an alkyl group (e.g. methyl, ethyl, or hexyl), an alkoxy group (e.g. methoxy, ethoxy, or octyloxy), an aryl group (e.g.

phenyl, naphthyl or tolyl), a hydroxy group, a halogen atom (e.g. fluorine, chlorine, bromine or iodine), an aryloxy group (e.g. phenoxy), an alkylthio group (e.g. methylthio or butylthio), an arylthio group (e.g. phenylthio), an acyl group (e.g. acetyl, propionyl, butylyl or valeryl), a sulfonyl group (an alkylsulfonyl or arylsulfonyl group, e.g. methylsulfonyl or phenylsulfonyl), an acylamino group (e.g. acetylamino or benzoylamino), an sulfonylamino group (e.g. methanesulfonylamino or benzenesulfonylamino), an acyloxy group (e.g. acetoxy or benzoxy), a carboxyl group, a cyano group, a sulfo group, an amino group, —$SO_2SM$ group (M is a monovalent cation) and $-SO_2R^1$.

The divalent linking group represented by L is an atom or atomic group comprising at least one selected from the group consisting of C, N, S and O, and specifically, an alkylene group, an alkenylene group, an alkynylene group, an arylene group, —O—, —S—, —NH—, —CO—, $SO_2$—, or any combination thereof.

L is preferably a divalent aliphatic group or a divalent aromatic group. Examples of the divalent aliphatic group represented by L are those specified below:

$$\text{-}(CH_2)_n\text{-}$$

where n is 1 to 12, —$CH_2$—CH=CH—$CH_2$—, —$CH_2$C≡C$CH_2$—,

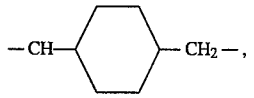

or a xylylene group.

Examples of the divalent aromatic group represented by L are a phenylene group and naphthylene group.

These substituent groups may be further substituted with any of the substituents set forth so far.

M is preferably a metal ion or an organic cation. Examples of the metal ion are lithium ion, sodium ion, and potassium ion. Examples of the organic cation are ammonium ion (e.g. ammonium, tetramethylammonium, or tetrabutylammonium), phosphonium ion (e.g. tetraphenylphosphonium), and guanidyl group.

When formulas (XI) to (XIII) represent polymers, the repeating unit of each is, for example, one represented by:

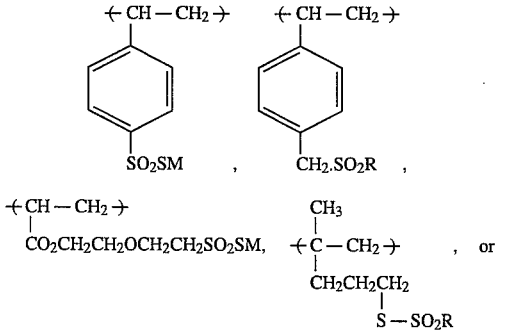

-continued

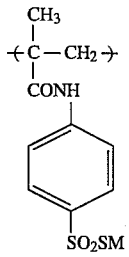

These polymers may be homopolymers, or copolymers formed along with other copolymerizable monomers.

Specific examples of the compounds represented by the formula (XI), (XII) and (XIII) will be listed below; however, the present invention is not limited to these examples.

$CH_3SO_2SNa$ (1-1)
$C_2H_5SO_2SNa$ (1-2)
$C_3H_7SO_2SK$ (1-3)
$C_4H_9SO_2SLi$ (1-4)
$C_6H_{13}SO_2SNa$ (1-5)
$C_8H_{17}SO_2SNa$ (1-6)

$CH_3(CH_2)_3CH(C_2H_5)CH_2SO_2S.NH_4$ (1-7)

$C_{10}H_{21}SO_2SNa$ (1-8)
$C_{12}H_{25}SO_2SNa$ (1-9)
$C_{16}H_{33}SO_2SNa$ (1-10)

$(CH_3)_3CH-SO_2SK$ (1-11)

t-$C_4H_9SO_2SNa$ (1-12)
$CH_3OCH_2CH_2SO_2S.Na$ (1-13)

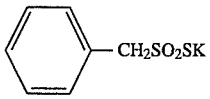
(1-14)

$CH_2{=}CHCH_2SO_2Na$ (1-15)

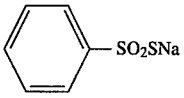
(1-16)

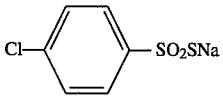
(1-17)

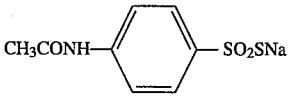
(1-18)

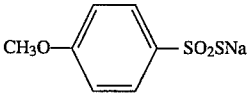
(1-19)

-continued
(1-20)
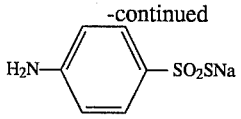
(1-21)
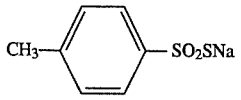
(1-22)
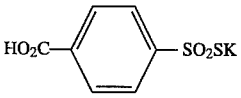
(1-23)
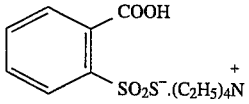
(1-24)
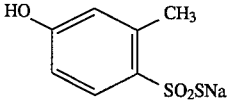
(1-25)
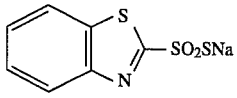
(1-26)
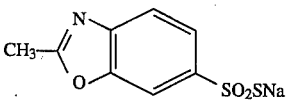
(1-27)
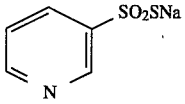
(1-28)
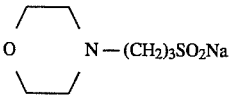
$KSSO_2(CH_2)_2SO_2SK$ (1-29)
$NaSSO_2(CH_2)_4SO_2SNa$ (1-30)
$NaSSO_2(CH_2)_4S(CH_2)_4SO_2SNa$ (1-31)
(1-32)
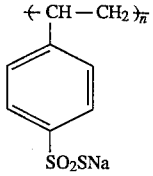
(1-33)
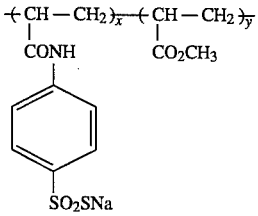
x:y = 1:1 (molar ratio)
$C_2H_5SO_2S-CH_3$ (2-1)
$C_8H_{17}SO_2SCH_2CH_3$ (2-2)
-continued
(2-3)
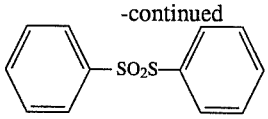
(2-4)
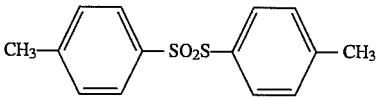
$C_2H_5SO_2SCH_2CH_2CN$ (2-5)
(2-6)
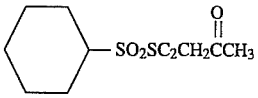
(2-7)
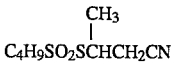
(2-8)
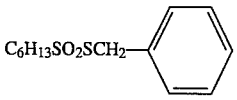
(2-9)
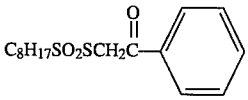
(2-10)
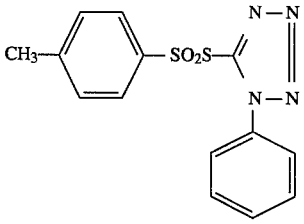
(2-11)
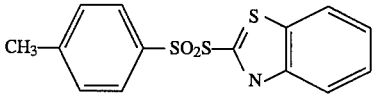
(2-12)
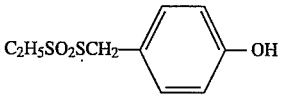
(2-13)
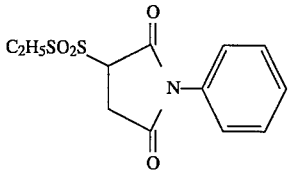
(2-14)
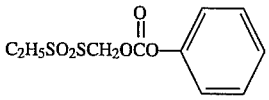
(2-15)
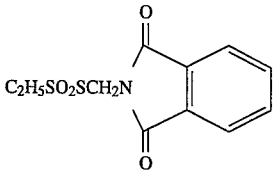

-continued (2-16)

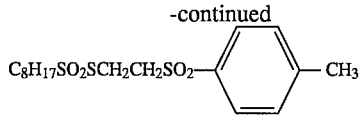

(2-17)

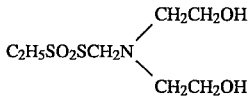

$C_2H_5SO_2SCH_2CH_2CH_2CH_2OH$ (2-18)

(2-19)

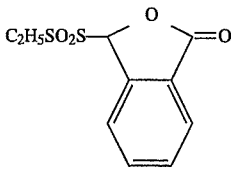

(2-20)

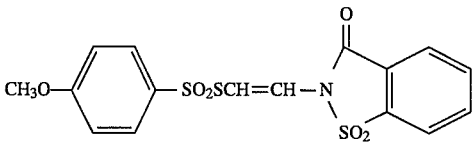

$CH_3SSO_2(CH_2)_4SO_2SCH_3$ (2-21)

$CH_3SSO_2(CH_2)_2SO_2SCH_3$ (2-22)

(2-23)

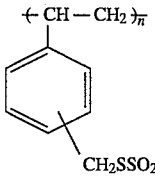

(2-24)

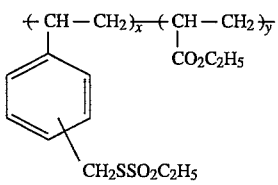

x:y = 2:1 (molar ratio)

(2-25)

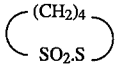

(3-1)

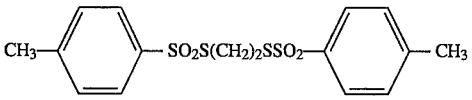

$C_2H_5SO_2SCH_2CH_2SO_2CH_2CH_2SSO_2C_2H_5$ (3-2)

(3-3)

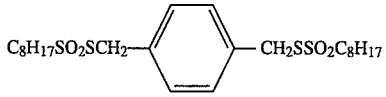

(3-4)

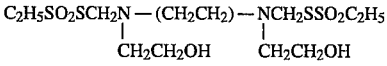

(3-5)

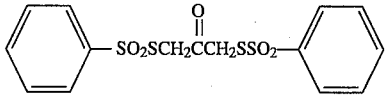

-continued (3-6)

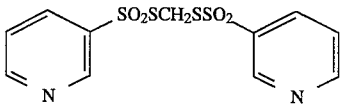

$C_2H_5SO_2SSSO_2C_2H_5$ (3-7)

$(n)C_3H_7SO_2SSSO_2C_2H_7(n)$ (3-8)

(3-9)

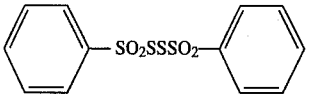

The compounds represented by the formulas (XI), (XII) and (XIII) can be synthesized easily by any methods disclosed or cited in JP-A-54-1019, British Patent 972,211, Journal of Organic Chemistry, Vol. 53, page 396 (1988), and Chemical Abstracts, Vol. 59, 9776e.

A preferable amount of the compound represented by the formula (XI), (XII) or (XIII) is $10^{-7}$ to $10^{-1}$ mole per mole of silver halide, more preferably $10^{-6}$ to $10^{-2}$ mol/mol Ag, with $10^{-5}$ to $10^{-3}$ mol/mol Ag being most preferable.

For adding compounds represented by the formulas (XI) to (XIII), there can be applied a general method used for adding an additive to a photographic emulsion. Specifically, a water-soluble compound is dissolved to make an aqueous solution having an appropriate concentration, whereas a water-insoluble or slightly-soluble compound is dissolved into a proper solvent which can be mixed with water and does not have a bad influence on the photographic properties to make a solution. The solvent may be selected from an alcohol, a glycol, a ketone and an ester. Thus, the compound can be added in the form of an aqueous solution or an solution.

The compound represented by formula (XI), (XII) or (XIII) may be added at any step of the preparation of the emulsion, e.g., during the formation of the grain of silver halide photographic emulsion, or before or after the chemical sensitization. The compound is preferably added before or during the reduction sensitization, more preferably, added during the growth of the grains.

The compound may be added in advance in the reaction vessel, but is preferably added at an appropriate time during the formation of the grains. The compound represented by formula (XI), (XII) or (XIII) may be added in advance to an aqueous solution of a water-soluble silver salt or a water-soluble alkali halide, and grains can be formed with the solution. Alternatively, the solution of the compound represented by formula (XI), (XII) or (XIII) may be added, as the grains are being formed, several times in sequentially, or continuously over a long period of time.

The most preferable compound for the present invention is one represented by formula (XI).

As the most recent progress technique, apart from the reduction sensitization, for achieving a fine-grain high sensitivity, there is provided a method in which regular crystal grains, the grain shape and size distribution of which can be easily controlled, are used. Examples of the regular crystal grain are cubic crystals having (100) faces; octahedral crystals having (111) faces; and dodecahedral grains having (110) faces, as disclosed in JP-B-55-42737 and JP-A-60-222842. Also, the grains having (h11) faces such as (211) faces, the grains having (hh1) faces such as (331) faces, the grains having (hk0) faces such as (210) faces and the grains having (hk1) such as (321) faces—all described in Journal of Imaging Science, vol. 30, p. 247 (1986)—can be used for specific purposes, though some care must be taken to prepare these grains. Further, grains in each of which two or more faces are co-present, for example, tetradecahedral grains in each of which (100) and (111) faces are co-present, grains in each of which (100) and (110) faces are co-present, or grains in each of which (111) and (110) faces are co-present, can be used for specific purposes.

A regular crystal grain preferable for the present invention is a grain whose ratio of (100) face to the total face is 60% or more. Such a preferable grain usually has a cubic shape. In some cases, other faces are co-present such that corners and edges are chipped off or rounded.

More preferably, the (100) face ratio should be 80% or more, with a (100) face ratio of 90% or more being most preferable to have a further complete cubic grain.

In order to measure the (100) face ratio of a regular crystal grain, there can be employed known methods, for example, the X-ray diffraction method in which the orientation of the grains is utilized, and the Kubla-Munk method in which the absorption spectrum of the sensitizing dyes adsorbed on silver halide grains is utilized.

The silver halide photographic emulsion used in the present invention is preferably subjected to selenium sensitization.

The selenium compounds disclosed in known patents may be used as the selenium sensitizing agent for the present invention. Generally, an unstable selenium compound and/or a non-unstable selenium compound are added to an emulsion, which is heated to a high temperature, preferably, 40° C. or higher, and stirred for a certain period of time. Examples of the unstable selenium compound are disclosed in JP-B-44-15748, JP-B-43-13489, JP-A-4-25832, JP-A-4-109240 or the like.

Specific examples of the unstable selenium sensitizing agent are an isoselenocyanate (e.g., an aliphatic isoselenocyanate such as allylisoselenocyanate), a selenourea, a selenoketone, a selenoamide, a selenocarboxylic acid (e.g., 2-selenopropionic acid or 2-selenobutyric acid), a selenoester, a diacetylselenide (e.g., bis(3-chloro-2,6-dimethoxybenzoyl)selenide), a selenophosphate, a phosphineselenide and collodial metal selenium.

Preferable unstable selenium compounds are listed as above; however the present invention is not limited to those compounds. It is known to a person skilled in the art that the structure of the unstable selenium compound used as the sensitizing agent for the photographic emulsion, is not very important as long as the compound is unstable, and that the organic portion of a selenium sensitizer molecule does not have any function but to carry selenium and make it present in an unstable form in the emulsion. The present invention effectively utilizes an unstable selenium compound within such a broad concept.

Compounds disclosed in JP-B-46-4553, JP-B-52-34492 and JP-B-52-34491 can be used as the non-unstable selenium compound for the present invention. Examples of the non-unstable selenium compound are a selenius acid, potassium selenocyanate, a selenazol, a quaternery salt of a selenazol, diarylselenide, diaryldiselenide, dialkylselenide, dialkyldiselenide, 2-selenazolidinedione, 2-selenaoxazolidinethion, and a derivative thereof.

Of the selenium compounds, preferable ones are those represented by formula (I) below or formula (II) below.

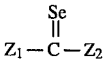

Formula (I)

In the formula (I), $Z_1$ and $Z_2$ may be the same or different, and each represents an alkyl group (e.g. methyl, ethyl, t-butyl, adamantyl or t-octyl), an alkenyl group (e.g. vinyl or propenyl), an aralkyl group (e.g. benzyl or phenethyl), an aryl group (e.g. phenyl, pentafluorophenyl, 4-chlorophenyl, 3-nitrophenyl, 4-octylsulfamoylphenyl, α-naphthyl), a heterocyclic ring (e.g. pyridyl, thienyl, furyl or imidazolyl), —NRi($R_2$), —$OR_3$ or —$SR_4$.

$R_1$, $R_2$, $R_3$ and $R_4$ may be the same or different, and each represents an alkyl group, an aralkyl group, an aryl group or a heterocyclic group. Examples of the alkyl group, the aralkyl group, the aryl group or the heterocyclic group are the same as those of $z_1$. Each of $R_1$ and $R_2$ may also be a hydrogen atom or an acyl group (e.g. acetyl, propanoyl, benzoyl, heptafluorobutanyl, difluoroacetyl, 4-nitrobenzoyl, α-naphthoyl, or 4-trifluoromethylbenzoyl).

In the formula (I), $Z_1$ is preferably an alkyl group, an aryl group or —$NR_1$ ($R_2$), and $Z_2$ preferably represents —$NR_5(R_6)$, wherein $R_1$, $R_2$, $R_5$ and $R_6$ may be the same or different, and each represents a hydrogen atom, an alkyl group, an aryl group or an acyl group.

The compound represented by the formula (I) is more preferably an N,N-dialkylselenourea, an N,N,N'-trialkyl-N'-acylselenourea, a tetraalkylselenourea, an N,N-dialkyl-arylselenoamide or an N-alkyl-N-aryl-arylselenoamide.

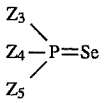

Formula (II)

In the formula (II), $Z_3$, $Z_4$ and $Z_5$ may be the same or different, and each represents an aliphatic group, an aromatic group, a heterocyclic group, —$OR_7$, —$NR_8(R_9)$, —$SR_{10}$, —$SeR_{11}$, X or a hydrogen atom.

Each of $R_7$, $R_{10}$ and $R_{11}$ represents an aliphatic group, an aromatic group, a heterocyclic group, a hydrogen atom or a cation, each of $R_8$ and $R_9$ represents an aliphatic group, an aromatic group, a heterocyclic group, or a hydrogen atom, and X represents a halogen atom.

In the formula (II), when $Z_3$, $Z_4$, $Z_5$, $R_7$, $R_8$, $R_9$, $R_{10}$ and $R_{11}$ are aliphatic groups, each of them is a saturated or unsaturated, straight-chain, branched or cyclic alkyl group, alkenyl group, alkynyl group or aralkyl group (e.g. methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl or phenethyl).

In the formula (II), when $Z_3$, $Z_4$, $Z_5$, $R_7$, $R_8$, $R_9$, $R_{10}$ and $R_{11}$ are aromatic groups, each of them is a single-ring or fused-ring aryl group (e.g. phenyl, pentafluorophenyl, 4-chlorophenyl, 3-sulfonyl, α-naphthyl or 4-methylphenyl).

In the formula (II), when $Z_3$, $Z_4$, $Z_5$, $R_7$, $R_8$, $R_9$, $R_{10}$ and $R_{11}$ are heterocyclic groups, each of them is a saturated or unsaturated, 3- to 10-membered heterocyclic group containing at least one of a nitrogen atom, oxygen atom and sulfur atom (e.g. pyridyl, thienyl, furyl, thiazolyl, imidazolyl or benzimidazolyl).

In the formula (II), when $R_7$, $R_{10}$ and $R_{11}$ are cations, each of them is an alkali metal atom or ammonium. The halogen atom represented by X is a fluorine atom, a chlorine atom, a bromine atom or an iodine.

In the formula (II), each of $Z_3$, $Z_4$ and $Z_5$ is preferably an aliphatic group, an aromatic group or —$OR_7$, and $R_7$ is preferably an aliphatic group or an aromatic group.

More preferably, the formula (II) represents a trialkylphosphynselenide, a triarylphosphynselenide, trialkylselenophosphate or a triarylselenophosphate.
Specific examples of the compound represented by the formulas (I) and (II) will be listed below; however the present invention is not limited to these examples.
1. 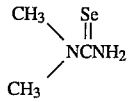
2. 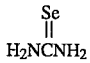
3. 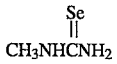
4. 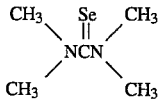
5. 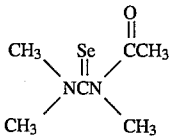
6. 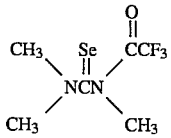
7. 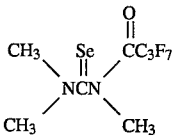
8. 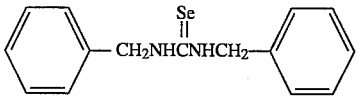
9. 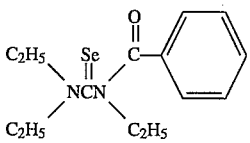
10. 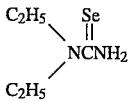
11. 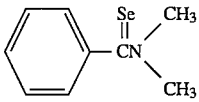
-continued
12. 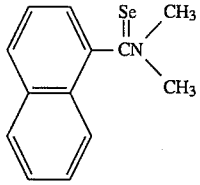
13. 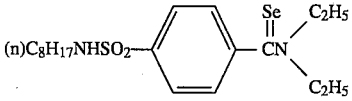
14. 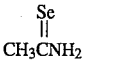
15. 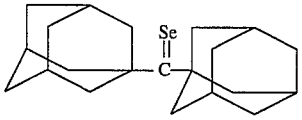
16. 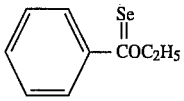
17. 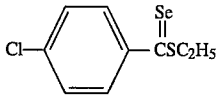
18. 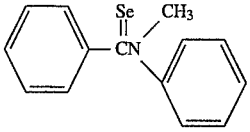
19. 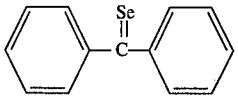
20. 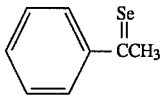
21. 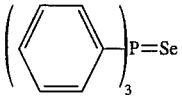
22. 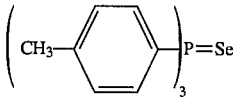
23. $(nC_4H_9)_3P{=}Se$
24. 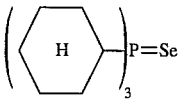

-continued

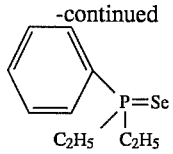

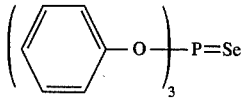

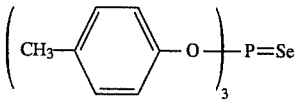

$(nC_4H_9O)_3P{=}Se$

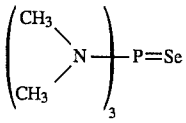

$(C_2H_5O)_3P{=}Se$

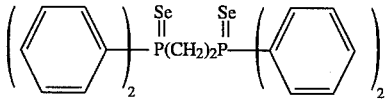

$(nC_8H_{17})_3P{=}Se$

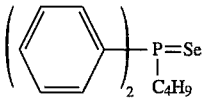

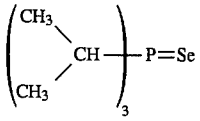

These selenium sensitizing agents can be dissolved into water, or a single organic solvent such as methanol or ethanol, or a mixture thereof, and added at the time of chemical sensitization. The sensitizer is preferably added before the initiation of the chemical sensitization. Two or more selenium sensitizing agents can be co-used, and a combination of an unstable selenium compound and a non-unstable compound is preferable.

The amount of addition of the selenium sensitizing agent used in the present invention depends on the activity of the selenium sensitizing agent used, the type or size of the silver halide, or the temperature or time of ripening, and is, preferably $1\times10^{-8}$ mole or more per mole of silver halide, more preferably, in a range between $1\times10^{-7}$ and $5\times10^{-5}$ mole per mole of silver halide. The temperature of the chemical ripening when the selenium sensitizing agent is used is preferably 45° C. or higher, and more preferably in a range between 50° C. and 80° C. The values of pAg and pH are arbitrary. For example, the effect of the present invention can be obtained over a wide pH range of 4 to 9.

The selenium sensitization is effectively achieved when carried out in the presence of a silver halide solvent.

Examples of the silver halide solvent applicable to the present invention are: (a) organic thioethers disclosed, for example, in U.S. Pat. Nos. 3,271,157, 3,531,289, and 3,574,628, JP-A-54-1019 and JP-A-64-158917; (b) thiourea derivatives disclosed, for example, in JP-A-53-82408, JP-A-55-77737 and JP-A-2982; (c) a silver halide solvent having a thiocarbonyl group interposed between an oxygen or sulfur atom and a nitrogen atom, disclosed in JP-A-53-144319; (d) an imidazole disclosed in JP-A-54-100717; (e) a sulfite salt; and (f) a thiocyanate.

More preferable examples of the silver halide solvent are a thiocyanate and tetramethylthiourea. For example, in the case of a thiocyanate, though the amount of solvent used may vary depending on its type, a preferable amount of the thiocyanate is in a range of $1\times10^{-4}$ and $1\times10^{-2}$ mole per mole of silver halide.

It is preferable for the emulsion of the present invention that sulfur sensitization and gold sensitization be co-used in the chemical sensitization.

The sulfur sensitization is carried out usually by adding a sulfur sensitizing agent to the emulsion, which is stirred at a high temperature, preferably 40° C. or more, for a predetermined period of time.

The gold sensitization is carried out usually by adding a gold sensitizing agent to the emulsion, which is stirred at a high temperature, preferably 40° C. or more, for a predetermined period of time.

A known sulfur sensitizing agent can be used for the sulfur sensitization. Examples of the sulfur sensitizing agent are thiosulfate, allylthiocarbamidothiourea, allylisothiacyanate, cystine, p-toluenethiosulfonic acid salt and rhodanine. Alternatively, sulfur sensitizing agents disclosed in U.S. Pat. Nos. 1,574,944, 2,410,689, 2,278,947, 2,728,668, 3,501,313, 3,656,955, German Patent 1,422,869, JP-B-56-24937, and JP-A-55-45016 can be used. The sulfur sensitizing agent may be used in an amount sufficient to effectively increase the sensitivity of the emulsion. The amount of the agent may vary under several conditions including pH, temperature, size of silver halide grains and the like, but is preferably in a range between $1\times10^{-7}$ and $5\times10^{-5}$ mole per mole of silver halide. The molar ratio of the sulfur sensitizing agent with respect to the selenium sensitizing agent is arbitrary, but is preferably equimolar or higher than that of the selenium sensitizing agent.

Regarding the gold sensitizing agent for the gold sensitization, the oxidation number of gold may be +1 or 3, and a gold compound generally used as a gold sensitizing agent may be used. Typical examples of the gold compound are chloroaurate, potassium chloroaurate, auric trichloride, potassium auric thiocyanate, potassium iodoaurate, tetracyanoauric acid, ammonium aurothiocyanate, and pyridyltrichlorogold.

The amount of the gold sensitizing agent added may vary under different conditions, but is preferably between $1\times10^{-7}$ and $5\times10^{-5}$ mole per mole of silver halide.

In the chemical ripening, it is not necessary to set the timing and order of the addition of the silver halide solvent, selenium sensitizing agent, sulfur sensitizing agent and gold sensitizing agent. For example, at the initiation of chemical ripening or (preferably) during the chemical sensitization, those compounds may be added at the same time, or different times. Before addition, those compounds may be dissolved into water, or an organic solvent which mixes with water, such as a single solvent or a mixture of methanol, ethanol and acetone.

The light-sensitive material of the present invention needs only to have at least one of the following silver halide emulsion layers, i.e., a blue-sensitive layer, a green-sensitive layer, and a red-sensitive layer, formed on a support. The number or order of the silver halide emulsion layers and the non-light-sensitive layers are not particularly limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers, such as various types of interlayers, may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity or speed is sequentially decreased toward the support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

AS described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

To improve the color reproduction, a donor layer (CL) of an interlayer effect can be arranged directly adjacent to, or close to, a main light-sensitive layer such as BL, GL or RL. The donor layer has a spectral sensitivity distribution which is different from that of the main light-sensitive layer. Donor layers of this type are disclosed in U.S. Pat. Nos. 4,663,271, 4,705,744, 4,707,436, JP-A-62-160448, and JP-A-63-89850.

As described above, various layer configurations and arrangements can be selected in accordance with the application of the light-sensitive material.

A preferable silver halide contained in photographic emulsion layers of the photographic light-sensitive material of the present invention is silver bromoiodide, silver chloroiodide, or silver chlorobromoiodide containing about 30 mol% or less of silver iodide. The most preferable silver halide is silver bromoiodide or silver chlorobromoiodide containing about 2 mol% to about 10 mol% of silver iodide.

Silver halide grains contained in the photographic emulsion may have regular crystals such as cubic, octahedral, or tetradecahedral crystals, irregular crystals such as spherical, or tabular crystals, crystals having defects such as twin planes, or composite shapes thereof.

The silver halide may consist of fine grains having a grain size of about 0.2 μm or less or large grains having a projected-area diameter of up to 10 μm, and the emulsion may be either a polydisperse emulsion or a monodisperse emulsion.

The silver halide photographic emulsion which can be used in the present invention can be prepared by methods described in, for example, Research Disclosure (RD) No. 17643 (December 1978), pp. 22 to 23, "I. Emulsion preparation and types", RD No. 18716 (November 1979), page 648, and RD No. 307105 (November 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394, and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226; 4,414,310; 4,433,048 and 4,499,520, and British Patent 2,112,157.

The crystal structure may be uniform, may have different halogen compositions in the interior and the surface thereof, or may be a layered structure. Alternatively, silver halides having different compositions may be joined by an epitaxial junction, or a compound other than a silver halide such as silver rhodanide or zinc oxide may be joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in RD Nos. 17,643; 18,716 and 307,105 and they are summarized in the table represented later.

In the light-sensitive material of the present invention, two or more types of emulsions different in at least one feature such as grain size, grain size distribution, a halogen composition, grain shape, and sensitivity can be mixed and used in the same layer.

Surface-fogged silver halide grains described in U.S. Pat. No. 4,082,553, internally fogged silver halide grains described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed despite the presence of a non-exposed portion and exposed portion of the light-sensitive material. A method of preparing the internally fogged or surface-fogged silver halide grain is described in U.S. Pat. No. 4,626,498 or JP-A-59-214852.

The silver halides which form the core of the internally fogged or surface-fogged core/shell silver halide grains may be of the same halogen composition or different halogen compositions. Examples of the internally fogged or surface-fogged silver halide are silver chloride, silver bromochloride, silver bromoiodide, and silver bromochloroiodide. Although the grain size of these fogged silver halide grains is not particularly limited, an average grain size is preferably 0.01 to 0.75 μm, and most preferably, 0.05 to 0.6 μm. The grain shape is also not particularly limited, and may be a regular grain shape. Although the emulsion may be a polydisperse emulsion, it is preferably a monodisperse emulsion (in which at least 95% in weight or number of silver halide grains have a grain size falling within a range of 40% of the average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol% of silver bromide and may contain silver chloride and/or silver iodide as needed. Preferably, the fine grain silver halide contains 0.5 to 10 mol% of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing a normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table:

| Additives | RD17643 | RD18716 | RD307105 |
|---|---|---|---|
| 1. Chemical sensitizers | page 23 | page 648, right column | page 866 |
| 2. Sensitivity-increasing agents | | page 648, right column | |
| 3. Spectral sensitizers, super-sensitizers | pp. 23–24 | page 648, right column to page 649, right column | pp. 866–868 |
| 4. Brighteners | page 24 | page 648, right column | page 868 |
| 5. Antifoggants, stabilizers | pp. 24–25 | page 649, right column | pp. 868–870 |
| 6. Light absorbent, filter dye, ultra-violet absorbents | pp. 25–26 | page 649, right column to page 650, left column | page 873 |
| 7. Stain-preventing agents | page 25, right column | page 650, left-right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. Nos. 4,411,987 or 4,435,503, which can react with formaldehyde and fix the same, is preferably added to the light-sensitive material.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-l-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425, 020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, west German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD NO. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

RD Nos. 11449 and 24241, and JP-A-61-201247, for example, disclose couplers which release bleaching accelerators. These couplers effectively serve to shorten the time of any process that involves bleaching. They are effective, particularly when added to a light-sensitive material containing tabular silver halide grains. Preferable examples of a coupler, which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glyceroltributyrate, isostearyllactate, and trioctylcltrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of an immersing latex are described in, e.g., U.S. Pat. No. 4,199,363 and German Laid-open Patent Application (OLS) Nos. 2,541,274 and 2,541,230.

Various types of antiseptics and fungicides are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and a color reversal paper.

A support which can be suitably used in the present invention is described in, e.g., RD. No. 17643, page 28, RD.

No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{1/2}$ is preferably 30 seconds or less, and more preferably, 20 seconds or less. The film thickness means a film thickness measured under moisture conditioning at a temperature of 25° C. and a relative humidity of 55% (two days). The film swell speed $T_{1/2}$ can be measured in accordance with a known method in the art. For example, the film swell speed $T_{1/2}$ can be measured by using a swellometer described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness–film thickness)/film thickness.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides and p-toluenesulfonates thereof. Of these compounds, 3-methyl-4-amino-N-ethyl-N-β-hydroxyethylaniline sulfate is preferred in particular. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof. The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

Aperture =[contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method described in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid, such as an iron (III) complex salt of ethylenediaminetetraacetic acid or 1,3-diaminopropanetetraacetic acid, is preferred because it can increase the processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in west German Patent 1,127,715 and JP-A-58-16235; polyoxyethylene compounds described in West German Patents 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. Further, in order to stabilize the fixing solution or the bleach-fixing solution, various types of aminopolycarboxylic acids or organic phosphonic acids are preferably added to the solution.

In the present invention, 0.1 to 10 moles, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of the desilvering step is preferably as short as possible as long as no desilvering defect occurs. A preferable time is one to three minutes, and more preferably, one to two minutes. A processing temperature is 25° C. to 50° C., and preferably, 35° C. to 45° C. within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite. Various chelating agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

Further, the silver halide light-sensitive material of the present invention can be applied also to a heat-developing light-sensitive material as disclosed in, e.g., U.S. Pat. No. 4,500,626, JP-A-60-133449, JP-A-59-218443, JP-A-61-238056, and European Patent 210,660A2.

The silver halide color light-sensitive material of the present invention exerts its advantages more effectively when applied to a film unit equipped with a lens disclosed in JP-B-2-32615 or Examined Published Japanese Utility Model Application (JU-B) 3-39782.

The present invention will now be described in further detail with reference to Examples, but is not limited to these Examples.

EXAMPLE 1

When forming tabular silver bromoiodide emulsion grains which had an average iodide content of 4.5 mol %, and an average equivalent-sphere diameter of 0.85 μm, in which 90% or more of the projected area of the total grains is occupied by tabular grains, and which has an average aspect ratio of 7.5, thiourea dioxide was added at a ratio of $3\times10^{-6}$ mole per mole of silver halide when 60% of the grains in terms of the total volume was formed, and the compound (1–2) indicated before was added at a ratio of $5\times10^{-5}$ mole per mole of silver halide when 95% of the grains in terms of total volume was formed, thus preparing tabular emulsion grains, the inside of each of which grains was reduction-sensitized. Then, the prepared emulsion was washed with water, and re-dispersed with addition of gelatin. Then, the emulsion was spectrally sensitized and chemically sensitized with use of sensitizing dyes EXS-1 to EXS-3 indicated below, potassium thiocyanate, chloroauric acid, sodium thiosulfate, and a selenium sensitizing agent (compound 21), so as to optimize the 1/100" sensitivity.

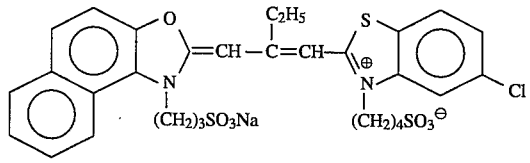

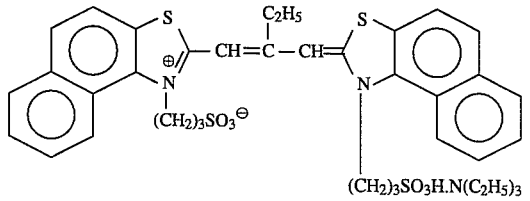

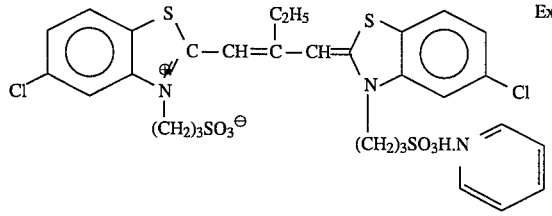

Next, the prepared emulsion was divided into 18 portions, and an antioxidizing agent listed in the below Table 1 was added to each of the portions. After storing the portions at the temperatures and for the time periods specified in Table 1, the emulsion portions were coated on supports as described below, thereby obtaining samples 101 to 118.

TABLE 1

| Sample | Emulsion Storage Conditions | Antioxidizing Agent | | |
|---|---|---|---|---|
| 101 | Coated immediately after preparation of emulsion (within 1 hour) (A) | | | |
| 102 | Coated 2 weeks after preparation of emulsion having been stored at 7° C. (B) | None | | Comparative example |
| 103 | Coated 2 months after preparation of emulsion having been stored at 7° C. (C) | | | |
| 104 | (A) | | | |
| 105 | (B) | Ascorbic acid | $1 \times 10^{-4}$ mol/mol of silver | Present invention |
| 106 | (C) | | | |
| 107 | (A) | | | |
| 108 | (B) | Ascorbic acid | $1 \times 10^{-3}$ mol/mol of silver | Present invention |
| 109 | (C) | | | |
| 110 | (A) | | | |
| 111 | (B) | (A-18) | $1 \times 10^{-4}$ mol/mol of silver | Present invention |
| 112 | (C) | | | |
| 113 | (A) | | | |
| 114 | (B) | (A-18) | $1 \times 10^{-3}$ mol/mol of silver | Present invention |
| 115 | (C) | | | |
| 116 | (A) | | | |
| 117 | (B) | (A-75) | $1 \times 10^{-3}$ mol/mol of silver | Present invention |
| 118 | (C) | | | |

The emulsions described above were each formed on a triacetylcellulose film substrate on which an underlayer was provided, after the completion of preparation of the coating liquid specified in the Table 2.

TABLE 2

| Emulsion coating conditions | |
|---|---|
| (1) Emulsion layer | |
| Emulsion . . . emulsion described above (silver $3.6 \times 10^{-2}$ mol/m$^2$) | |
| Coupler indicated below ($1.5 \times 10^{-3}$ mol/m$^2$) | |
| Tricresyl phosphate | (1.10 g/m$^2$) |
| Gelatin | (2.30 g/m$^2$) |
| (2) Protective layer | |
| 2,4-dichloro-6-hydroxy-s-triazine sodium salt | (0.08 g/m$^2$) |
| Gelatin | (1.80 g/m$^2$) |

Each sample was left for 14 hours under the conditions, i.e. a temperature of 40° C. and a relative humidity of 70%, and was exposed to light for 1/100 sec via a Fuji Film yellow filter (SC-62) continuous wedge. Then, the color development specified in the Table A was carried out.

By use of a green filter, the density of each sample which has been treated was measured.

TABLE A

| Steps | Time | Temperature |
|---|---|---|
| Color development | 2 min 00 sec | 40° C. |
| Bleach-Fix | 3 min 00 sec | 40° C. |
| Water washing (1) | 20 sec | 35° C. |
| Water washing (2) | 20 sec | 35° C. |
| Stabilization | 20 sec | 35° C. |
| Drying | 50 sec | 65° C. |

The compositions of the processing solutions were as follows:

| (Color Developing Solution) | (gram) |
|---|---|
| Diethylenetriamine-pentaacetic acid | 2.0 |
| 1-hydroxyethylidene-1, 1-diphsophonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethylamino)-2-methylaniline sulfate | 4.5 |
| water to make | 1.0 litter |
| pH | 10.5 |

| (Bleach-fix solution) | (gram) |
|---|---|
| Ammonium ferric ethylenediamine-tetraacetate dehydrate | 90.0 |
| Disodium ethylenediaminetetraacetate dehydrate | 5.0 |
| Sodium sulfite | 12.0 |
| Ammonium thiosulfate aqueous solution (70%) | 260.0 ml |
| Acetic acid (98%) | 5.0 ml |
| Bleaching accelerator | 0.01 mol |

-continued

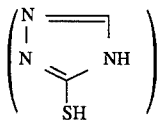

| | |
|---|---|
| Water to make | 1.0 l |
| pH | 6.0 |

(Water washing solution)

Tap water was treated with a mixed-bed column filled with H-type strong-acid cation exchange resin (Amberlite IR-120B available from Rohm and Haas, CO.) and OH-type anion exchange resin (Amberlite IR-400)., whereby the calcium and magnesium ion concentration of the water was reduced to 3 mg/liter or less. Further, 20 mg/liter of sodium isocyanurate dichloride and 1.5 g/liter of sodium sulfate were added.

The solution had a pH in the range of 6.5–7.5.

| (Stabilizing solution) | (gram) |
|---|---|
| Formalin (37%) | 2.0 ml |
| Polyoxyethylene-p-monononylphenyl ether (average polymerization degree: 10) | 0.3 |
| Disodium ethylenediamine tetraacetate | 0.05 |
| Water to make | 1.0 liter |
| pH | 5.0–8.0 |

The photographic sensitivity of each sample is represented in the relative value of a reciprocal of the exposure amount represented by lux.sec which gave an optical density of fog +0.2.

The results obtained are summarized in the following Table 3.

TABLE 3

| | Sample | Fog | Sensitivity (relative value) |
|---|---|---|---|
| Comparative example | 101 | 0.15 | 100 |
| | 102 | 0.25 | 80 |
| | 103 | 0.50 | 50 |
| Present invention | 104 | 0.16 | 95 |
| | 105 | 0.19 | 82 |
| | 106 | 0.24 | 70 |
| Present invention | 107 | 0.20 | 85 |
| | 108 | 0.26 | 71 |
| | 109 | 0.40 | 65 |
| Present invention | 110 | 0.15 | 100 |
| | 111 | 0.14 | 103 |
| | 112 | 0.15 | 102 |
| Present invention | 113 | 0.14 | 105 |
| | 114 | 0.15 | 103 |
| | 115 | 0.14 | 106 |
| Present invention | 116 | 0.14 | 102 |
| | 117 | 0.14 | 104 |
| | 118 | 0.15 | 103 |

It is clear from Table 3 that comparative samples, to which no antioxidizing agent was added, exhibited the deterioration of photographic properties, for example, an increase in fog and an decrease in sensitivity, due to the storage of the emulsion after the preparation thereof and before the coating. It is also clear that the deterioration of the properties can be reduced by an antioxidizing agent, and especially, with addition of the compound represented by the formula (A) of the present invention, the change of the properties due to the storage of the emulsion after the preparation can be substantially completely suppressed without changing the properties of the emulsion as compared to the emulsions to which no antioxidizing agents were added.

EXAMPLE 2

When forming tabular silver bromoiodide emulsion grains having an average iodide content of 8.5 mol %, an average equivalent-sphere diameter of 1.1 μm, and an average aspect ratio of 3.5, after 60% of the grains in terms of total volume was formed, the emulsions were subjected to the reduction sensitization by the following methods A to H. Further, the prepared emulsions were water-washed, dispersed, spectrally sensitized, and chemically sensitized as set forth in Table 4. After that, the antioxidizing agent listed in Table 4 was added to the emulsion, thereby obtaining Emulsions 201 to 232.

Reduction sensitization method:

A: Grains were formed by raising the pH during formation of the grains from 4.8 to 6.0.

B: Grains were formed by lowering the pAg during formation of the grains from 8.2 to 7.0.

C: During the formation of grains, thiourea dioxide was added at a ratio of $4\times10^{-6}$ mole per mole of silver halide, and the reduction sensitization was carried out.

D: During the formation of grains, tin chloride ($SnCl_2$) was added at a ratio of $6\times10^{-7}$ mole per mole of silver halide, and the reduction sensitization was carried out.

E: During the formation of grains, L-ascorbic acid was added at a ratio of $1\times10^{-4}$ mole per mole of silver halide, and the reduction sensitization was carried out.

F: At the time when 60% of the grains in terms of the total volume was formed, thiourea dioxide was added at a ratio of $3\times10^{-5}$ mole per mole of silver halide, and after the completion of formation of the grains, the compound (1–2) was added at a ratio of $9\times10^{-5}$ mole per mole of silver halide, thus performing the reduction sensitization.

G: At the time when 60% of the grains in terms of total volume was formed, thiourea dioxide was added at a ratio of $3\times10^{-5}$ mole per 1 mole of silver halide, and at the time when 95% of the grains in terms of the total volume was formed, the compound (1–2) was added at a ratio of $7\times10^{-5}$ mole per mole of silver halide, thus performing the reduction sensitization.

H: The reduction sensitization was not performed during the formation of grains.

The emulsions prepared as above were stored for different time periods as set forth in Table 4, and as in Example 1, the emulsions were coated on supports, the samples were exposed, and developed, and the properties thereof were measured. The results are summarized also in Table 4.

TABLE 4

| Emulsion No. | Reduction Sensitization | Chemical sensitization | Antioxidizing agent | Storage condition (A) Fog | Storage condition (A) Sensitivity | Storage condition (C) Fog | Storage condition (C) Sensitivity | |
|---|---|---|---|---|---|---|---|---|
| 201 | A | Gold-sulfer | none | 0.19 | 115 | 0.50 | 65 | Comparative example |
| 202 | B | " | " | 0.20 | 110 | 0.49 | 63 | " |
| 203 | C | " | " | 0.21 | 135 | 0.55 | 70 | " |
| 204 | D | " | " | 0.21 | 130 | 0.53 | 68 | " |
| 205 | E | " | " | 0.22 | 130 | 0.54 | 69 | " |
| 206 | F | " | " | 0.18 | 145 | 0.40 | 85 | " |
| 207 | G | " | " | 0.16 | 155 | 0.40 | 90 | " |
| 208 | H | " | " | 0.15 | 100 | 0.30 | 80 | " |
| 209 | A | " | (A-18)5 × $10^{-4}$ mol | 0.18 | 116 | 0.30 | 100 | Present invention |
| 210 | B | " | " | 0.20 | 111 | 0.29 | 98 | " |
| 211 | C | " | " | 0.20 | 134 | 0.32 | 105 | " |
| 212 | D | " | " | 0.20 | 132 | 0.32 | 107 | " |
| 213 | E | " | " | 0.21 | 132 | 0.31 | 106 | " |
| 214 | F | " | " | 0.17 | 146 | 0.18 | 143 | " |
| 215 | G | Gold-sulfur | (A-18)5 × $10^{-4}$ mol | 0.15 | 157 | 0.15 | 155 | Present invention |
| 216 | H | " | " | 0.15 | 100 | 0.15 | 98 | " |
| 217 | A | Gold-sulfur-selenium | none | 0.21 | 140 | 0.55 | 75 | Comparative example |
| 218 | B | " | " | 0.23 | 135 | 0.57 | 73 | " |
| 219 | C | " | " | 0.24 | 160 | 0.70 | 80 | " |
| 220 | D | " | " | 0.24 | 155 | 0.68 | 81 | " |
| 221 | E | " | " | 0.23 | 160 | 0.69 | 82 | " |
| 222 | F | " | " | 0.21 | 170 | 0.50 | 90 | " |
| 223 | G | " | " | 0.18 | 185 | 0.48 | 95 | " |
| 224 | H | " | " | 0.18 | 120 | 0.45 | 70 | Present invention |
| 225 | A | " | (A-18)5 × $10^{-4}$ mol | 0.21 | 140 | 0.30 | 120 | " |
| 226 | B | " | " | 0.23 | 135 | 0.31 | 118 | " |
| 227 | C | " | " | 0.23 | 158 | 0.34 | 130 | " |
| 228 | D | " | " | 0.24 | 156 | 0.33 | 132 | " |
| 229 | E | Gold-sulfur-selenium | (A-18)5 × $10^{-4}$ mol | 0.24 | 162 | 0.34 | 133 | Present invention |
| 230 | F | " | " | 0.20 | 172 | 0.22 | 168 | " |
| 231 | G | " | " | 0.17 | 190 | 0.18 | 188 | " |
| 232 | H | " | " | 0.18 | 120 | 0.17 | 117 | " |

As is clear from Table 4, emulsions which were reduction-sensitized or selenium-sensitized exhibited excellent properties including a high sensitivity just after the preparation thereof; however, as those emulsions were stored after the preparation until the coating, significant deterioration of the properties occurred. With the antioxidizing agent of the present invention, the deterioration of the properties can be suppressed, thereby achieving emulsions having desirable properties.

EXAMPLE 3

Regular crystal emulsions having an average iodide content of 1.5 mol % and an average equivalent-sphere diameter of 0.55 μm were prepared as the ratio of the (100) face to the total face was varied by adjusting the potential during the formation of the grains. The variation coefficient of the distribution of grain size was 8 to 12%. During the formation of the grains, the reduction sensitization, as in Example 1, was carried out. Further, the prepared emulsions were water-washed, dispersed, spectrally sensitized, and chemically sensitized as set forth in Table 5. After that, the antioxidizing agent listed in Table 5 was added to the emulsion, thereby obtaining emulsions 301 to 320. The (100) face ratio set forth in Table 5 was determined by the Kublka-Munk method.

Those emulsions prepared as above were stored for different time periods as set forth in Table 5, and as in Example 1, the emulsions were coated on supports, the samples were exposed, and developed, and the properties thereof were measured. The results are summarized also in Table 5.

TABLE 5

| Emulsion No. | | Ratio of (100) face | Chemical sensitization | Antioxidizing agent | Storage condition (A) Fog | Storage condition (A) Sensitivity | Storage condition (C) Fog | Storage condition (C) Sensitivity |
|---|---|---|---|---|---|---|---|---|
| 301 | Comparative example | 10% | Gold-sulfur | none | 0.08 | 100 | 0.15 | 75 |
| 302 | " | 55% | " | " | 0.09 | 103 | 0.20 | 72 |
| 303 | " | 65% | " | " | 0.10 | 120 | 0.30 | 77 |
| 304 | " | 85% | " | " | 0.11 | 130 | 0.29 | 78 |
| 305 | " | 98% | " | " | 0.10 | 140 | 0.35 | 79 |

TABLE 5-continued

| Emulsion No. | | Ratio of (100) face | Chemical sensitization | Antioxidizing agent | Storage condition (A) Fog | Storage condition (A) Sensitivity | Storage condition (C) Fog | Storage condition (C) Sensitivity |
|---|---|---|---|---|---|---|---|---|
| 306 | " | 10% | Gold-sulfur-selenium | " | 0.10 | 115 | 0.17 | 85 |
| 307 | " | 55% | " | " | 0.10 | 120 | 0.22 | 80 |
| 308 | " | 65% | " | " | 0.12 | 150 | 0.30 | 82 |
| 309 | " | 85% | " | " | 0.11 | 155 | 0.38 | 75 |
| 310 | " | 98% | " | " | 0.11 | 165 | 0.50 | 80 |
| 311 | Present invention | 10% | Gold-sulfur | (A-52)8 × $10^{-5}$ mol | 0.08 | 100 | 0.10 | 95 |
| 312 | " | 55% | " | " | 0.08 | 101 | 0.09 | 98 |
| 313 | " | 65% | " | " | 0.10 | 120 | 0.11 | 121 |
| 314 | " | 85% | " | " | 0.10 | 131 | 0.12 | 133 |
| 315 | " | 98% | " | " | 0.10 | 139 | 0.10 | 140 |
| 316 | " | 10% | Gold-sulfur-selenium | " | 0.10 | 116 | 0.13 | 112 |
| 317 | " | 55% | " | " | 0.11 | 121 | 0.13 | 119 |
| 318 | " | 65% | " | " | 0.12 | 151 | 0.12 | 150 |
| 319 | " | 85% | " | " | 0.11 | 156 | 0.12 | 157 |
| 320 | " | 98% | " | " | 0.10 | 167 | 0.09 | 166 |

As is clear from Table 5, emulsions which have a (100) face ratio of 60% or more, or were selenium-sensitized exhibited excellent properties including a high sensitivity just after the preparation thereof; however, as those emulsions were stored after the preparation until the coating, significant deterioration of the properties occurred. With the antioxidizing agent of the present invention, the deterioration of the properties could be suppressed, thereby achieving emulsions having desirable properties. Example 4

The layers having the compositions stated below are laminated on a triacetylcellulose film substrate on which an underlayer was provided, thereby preparing multilayer color light-sensitive materials. The emulsions of Example 3, and Examples 1 and 2, were used as emulsion C for the third layer and emulsion D for the fourth layer. The similar effect was observed in each of these multilayer color light-sensitive materials. (Compositions of Light-sensitive layers)

The main elements used in each layer were the emulsion listed in Table 6 below, and those categorized below and listed below.

ExC: cyan coupler, UV: ultraviolet ray absorber, ExM: magenta coupler, HBS: high-boiling point organic solvent, ExY: yellow coupler, H: gelatin hardener, ExS: sensitizing dye The value corresponding to each composition indicates the coating amount in units of g/$m^2$, and the amount of silver halide coated is expressed in the silver amount. The amount of the sensitizing dye is expressed in units of mole per mole of silver halide in the same layer.

TABLE 6

| | Average AgI content (%) | Average gain diameter (μm) | Variation coefficient of grain diameter | Diameter/thickness | Silver amount ratio [core/intermediate/shell] (AgI content) | Grain structure/shape |
|---|---|---|---|---|---|---|
| Emulsion A | 1.5 | 0.30 | 10 | 1 | [1/1] (1/2) | Double structure cubic grain |
| B | 1.5 | 0.50 | 8 | 1 | [1/1] (1/2) | Double structure cubic grain |
| C | 3.0 | 0.45 | 25 | 7 | [10/60/30](0/1/8) | Double structure tabular grain |
| D | 2.8 | 0.80 | 18 | 6 | [14/56/30](0.2/1/7.5) | Double structure tabular grain |
| E | 2.3 | 1.10 | 16 | 6 | [6/64/30] (0.2/1/5.5) | Double structure tabular grain |
| F | 13.6 | 1.75 | 26 | 3 | [1/2] (41/0) | Double structure plate-like grain |
| G | 1.0 | 0.07 | 15 | 1 | — | Uniform structure fine grain |

In Table 6:

(1) Emulsions A-F were reduction-sensitized at the time of preparation of grains by use of thiourea dioxide and thiosulfonic acid in a manner as described in the Example disclosed in JP-A-2-191938.

(2) Emulsions A-F were gold-sensitized, sulfur-sensitized, and selenium-sensitized in the presence of the spectrally sensitizing dye indicated in each layer below and sodium thiocyanate in a manner as described in the Example disclosed in JP-A-3-237450.

(3) In the preparation of tabular grains, gelatin having a low molecular weight was used in a manner as described in the Example in JP-A-l-158426.

(4) In the tabular grains, dislocations as disclosed in JP-A-3-237450 were observed under a high-voltage electron microscope.

ExC-1
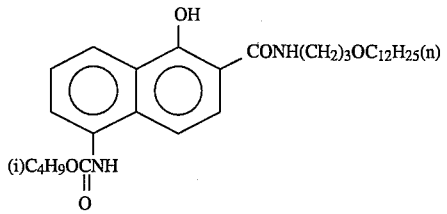
ExC-2
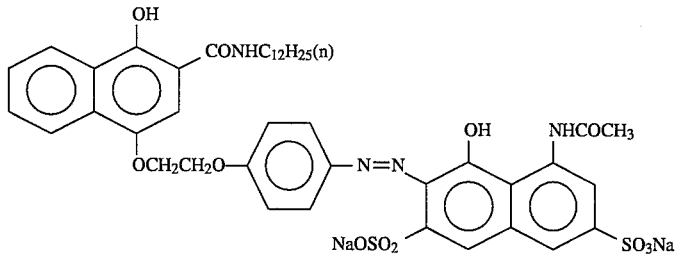
ExC-3
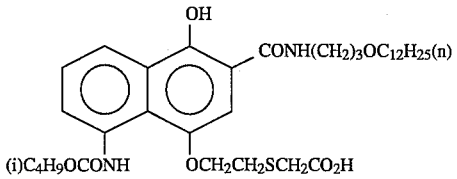
ExC-4
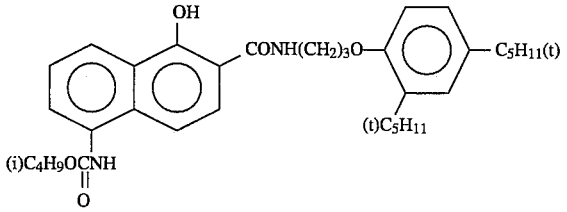
ExC-5
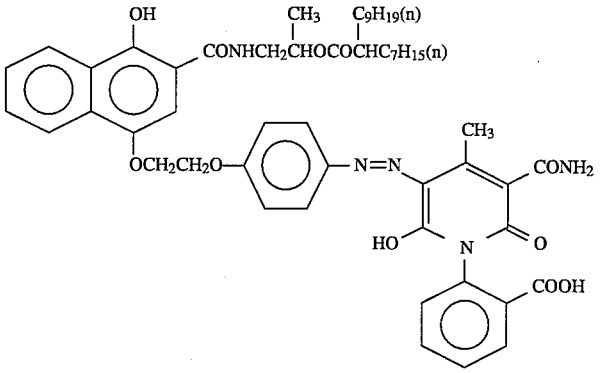
ExC-6
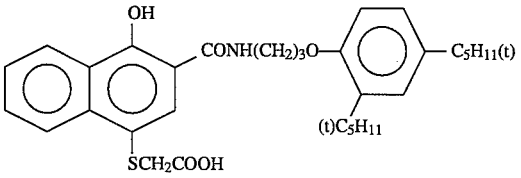

-continued
ExC-7
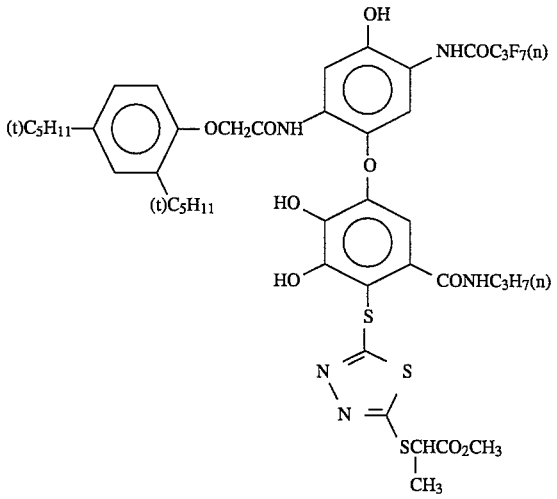
ExC-8
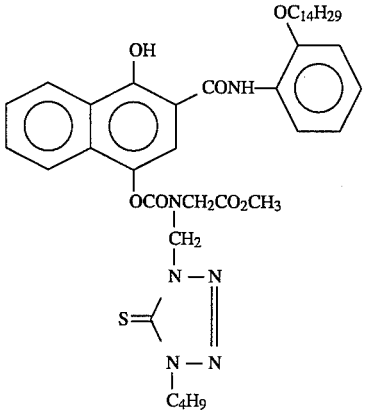
ExM-1
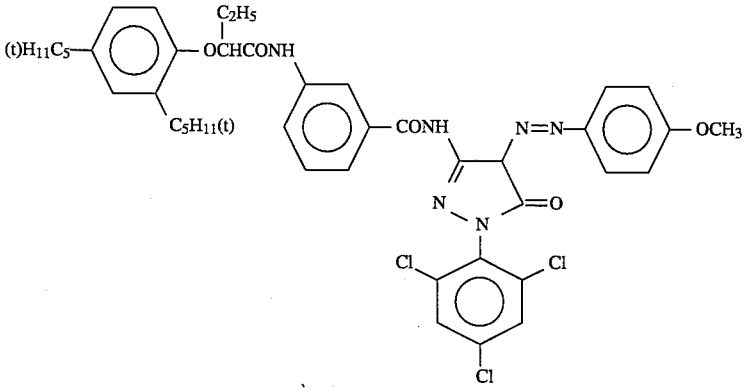

-continued
ExM-2
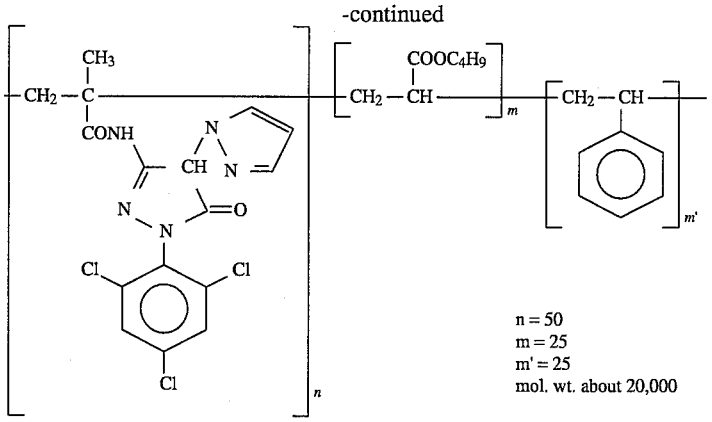
n = 50
m = 25
m' = 25
mol. wt. about 20,000
ExM-3
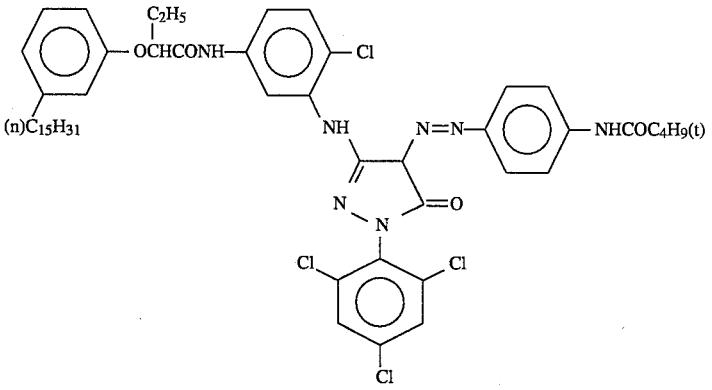
ExM-4
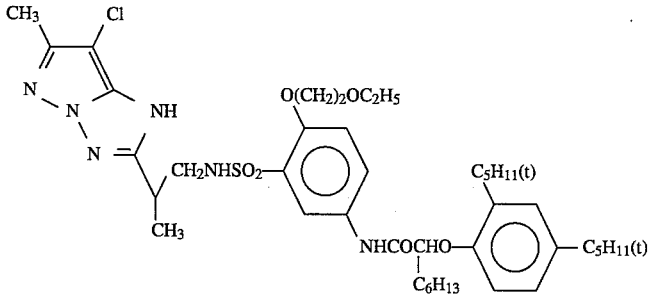
ExM-5
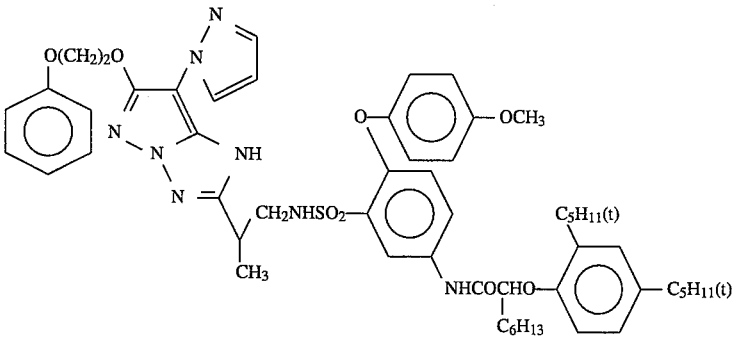

-continued
ExY-1
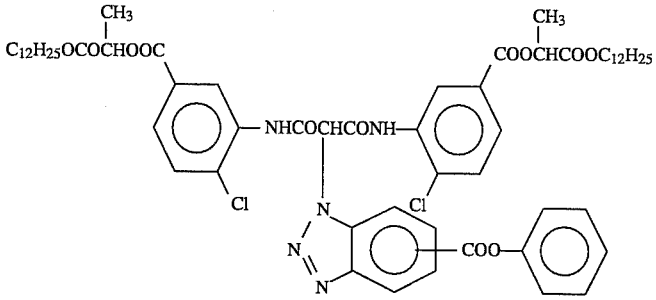
ExY-2
ExY-3
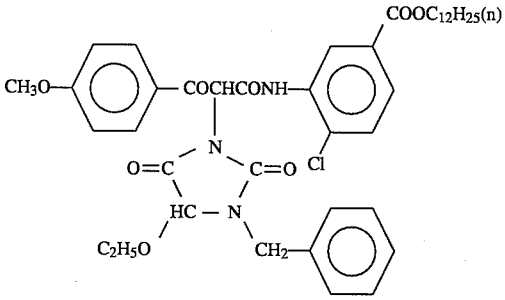
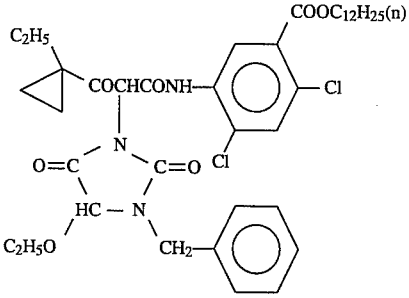
ExY-4
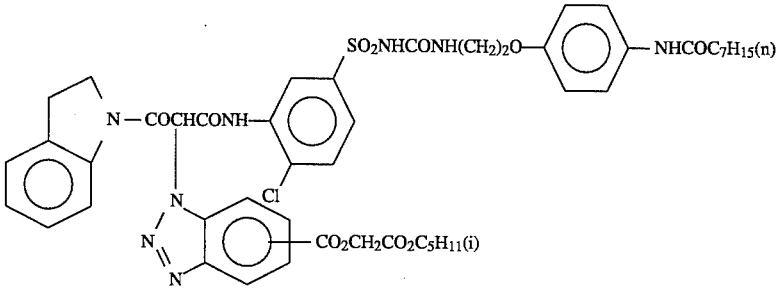
ExY-5
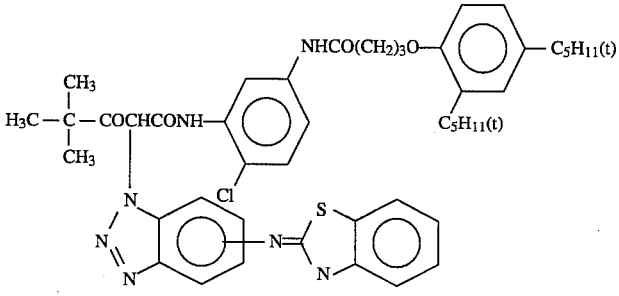
ExF-1
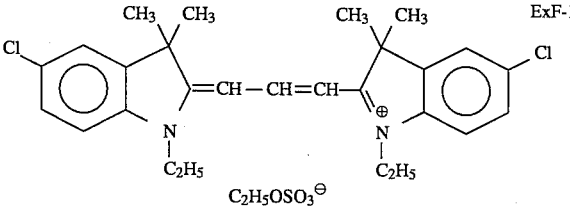
Cpd-1
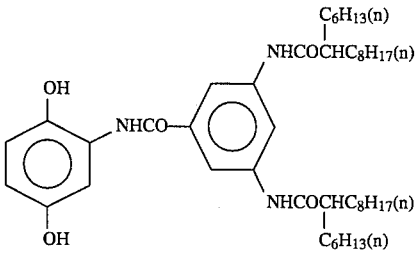
Cpd-2
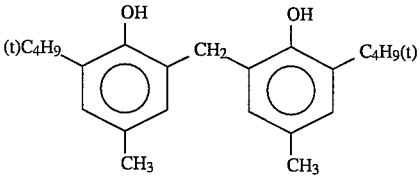
Cpd-3
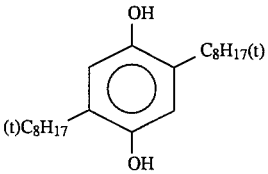

-continued
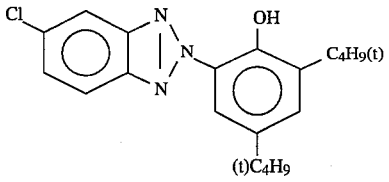
UV-1
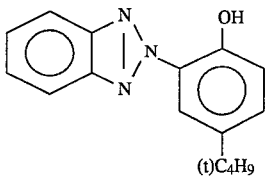
UV-2
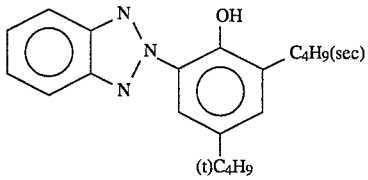
UV-3
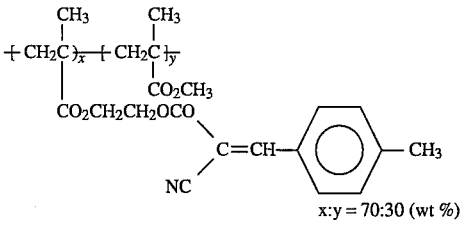
x:y = 70:30 (wt %)
UV-4
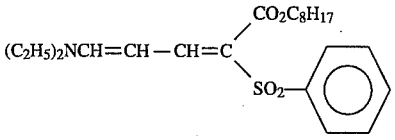
UV-5
tricresylphosphate
HBS-1
di-n-butylphthalate
HBS-2
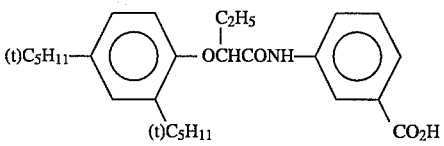
HBS-3
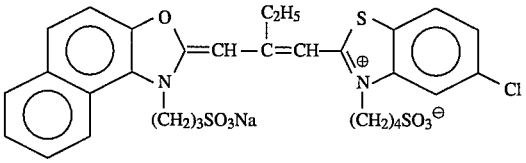
ExS-1
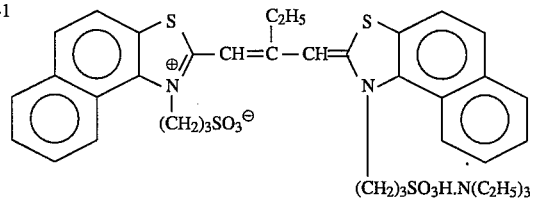
ExS-2
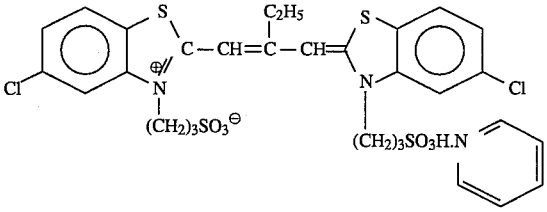
ExS-3
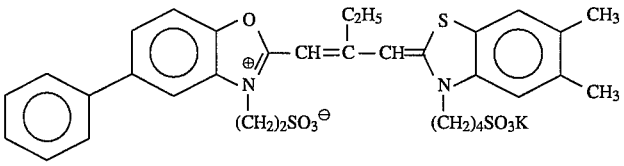
ExS-4
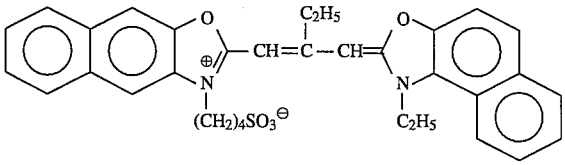
ExS-5

-continued
ExS-6
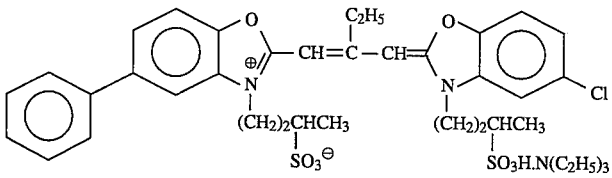
ExS-7
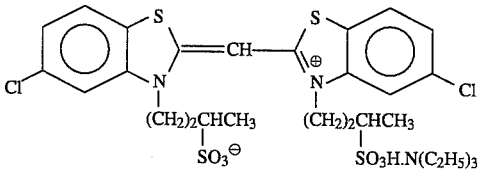
S-1
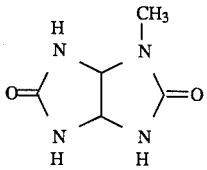
H-1
$CH_2{=}CH-SO_2-CH_2-CONH-CH_2$
$CH_2{=}CH-SO_2-CH_2-CONH-CH_2$
B-1
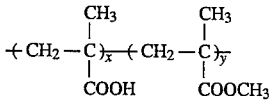
x/y = 10/90
B-2
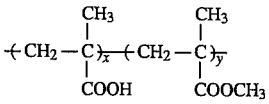
x/y = 40/60
B-3
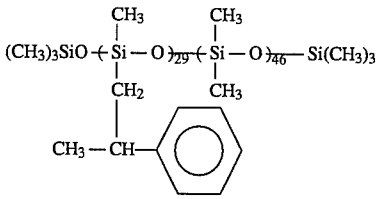
B-4
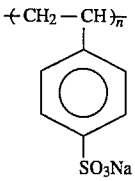
B-5
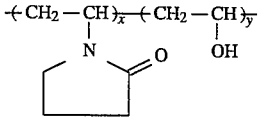
x/y = 70/30
B-6
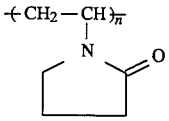
(mol. wt. about 10,000)
W-1
$C_8F_{17}SO_2NHCH_2CH_2CH_2OCH_2CH_2\overset{\oplus}{N}(CH_3)_3$
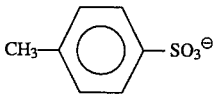
W-2
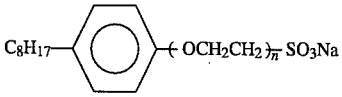
n = 2–4
W-3
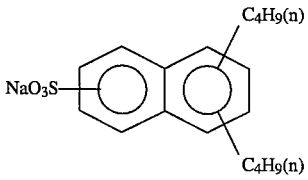
F-1
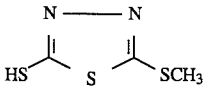
F-2
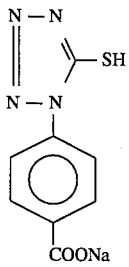

-continued
F-3
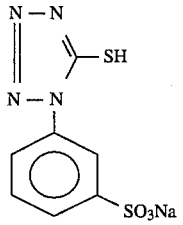
F-4
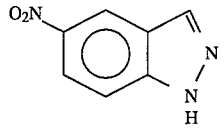
F-5
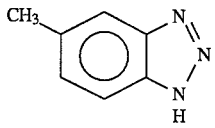
F-6
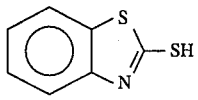
F-7
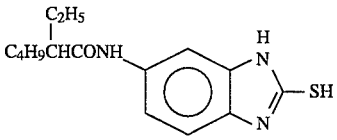
F-8
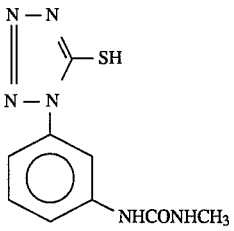
F-9
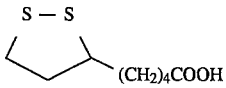
F-10
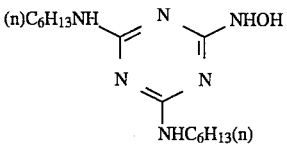
F-11
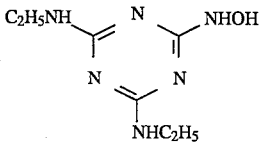
F-12
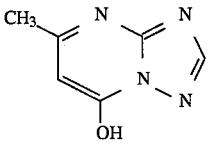
F-13
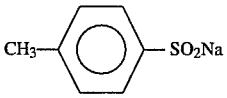
F-14
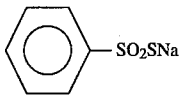
F-15
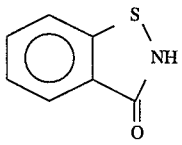
F-16
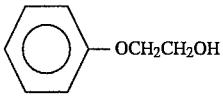
F-17
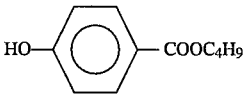
| Layer 1: Antihalation layer | |
|---|---|
| Black colloidal silver | 0.18 |
| Gelatin | 1.40 |
| ExM-1 | 0.18 |
| ExF-1 | $2.0 \times 10^{-3}$ |
| HBS | 0.20 |
| Layer 2: (Interlayer) | |
| Emulsion G silver | 0.065 |
| 2,5-di-t-pentadecylhydroquinone | 0.18 |
| ExC-2 | 0.020 |
| UV-1 | 0.060 |
| UV-2 | 0.080 |
-continued
| | |
|---|---|
| UV-3 | 0.10 |
| HBS-1 | 0.10 |
| HBS-2 | 0.020 |
| Gelatin | 1.04 |
| Layer 3: (Low-speed red-sensitive layer) | |
| Emulsion A silver | 0.25 |
| Emulsion C silver | 0.25 |
| ExS-1 | $4.5 \times 10^{-4}$ |
| ExS-2 | $1.5 \times 10^{-5}$ |
| ExS-3 | $4.5 \times 10^{-4}$ |
| ExC-1 | 0.17 |
| ExC-3 | 0.030 |
| ExC-4 | 0.10 |

-continued

| | |
|---|---|
| ExC-5 | 0.0050 |
| ExC-7 | 0.0050 |
| ExC-8 | 0.020 |
| Cpd-2 | 0.025 |
| HBS-1 | 0.10 |
| Gelatin | 0.87 |
| Layer 4: (Medium-speed red-sensitive emulsion layer) | |
| Emulsion D silver | 0.80 |
| ExS-1 | $3.0 \times 10^{-4}$ |
| ExS-2 | $1.2 \times 10^{-5}$ |
| ExS-3 | $4.0 \times 10^{-4}$ |
| ExC-1 | 0.15 |
| ExC-2 | 0.060 |
| ExC-4 | 0.11 |
| ExC-7 | 0.0010 |
| ExC-8 | 0.025 |
| Cpd-2 | 0.023 |
| HBS-1 | 0.10 |
| Gelatin | 0.75 |
| Layer 5: (High-speed red-sensitive emulsion layer) | |
| Emulsion E silver | 1.40 |
| ExS-1 | $2.0 \times 10^{-4}$ |
| ExS-2 | $1.0 \times 10^{-5}$ |
| ExS-3 | $3.0 \times 10^{-4}$ |
| ExC-1 | 0.095 |
| ExC-3 | 0.040 |
| ExC-6 | 0.020 |
| ExC-8 | 0.007 |
| Cpd-2 | 0.050 |
| HBS-1 | 0.22 |
| HBS-2 | 0.10 |
| Gelatin | 1.20 |
| Layer 6: (Interlayer) | |
| Cpd-1 | 0.10 |
| HBS-1 | 0.50 |
| Gelatin | 1.10 |
| Layer 7: (Low-speed green-sensitive emulsion layer) | |
| Emulsion A silver | 0.17 |
| Emulsion B silver | 0.17 |
| ExS-4 | $4.0 \times 10^{-5}$ |
| ExS-5 | $1.8 \times 10^{-4}$ |
| ExS-6 | $6.5 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| Layer 8: (Medium-speed green-sensitive emulsion layer) | |
| Emulsion D silver | 0.80 |
| ExS-4 | $2.0 \times 10^{-5}$ |
| ExS-5 | $1.4 \times 10^{-4}$ |
| ExS-6 | $5.4 \times 10^{-4}$ |
| ExM-2 | 0.16 |
| ExM-3 | 0.045 |
| ExY-1 | 0.01 |
| ExY-5 | 0.030 |
| HBS-1 | 0.16 |
| HBS-3 | $8.0 \times 10^{-3}$ |
| Gelatin | 0.90 |
| Layer 9: (High-speed green-sensitive emulsion layer) | |
| Emulsion E silver | 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.015 |
| ExM-4 | 0.040 |
| ExM-5 | 0.019 |
| Cpd-3 | 0.020 |
| HBS-1 | 0.25 |
| HBS-2 | 0.10 |

-continued

| | |
|---|---|
| Gelatin | 1.20 |
| Layer 10: (Yellow filter layer) | |
| Yellow colloidal silver | 0.010 |
| Cpd-1 | 0.16 |
| HBS-1 | 0.60 |
| Gelatin | 0.60 |
| Layer 11: (Low-speed blue-sensitive emulsion layer) | |
| Emulsion C silver | 0.25 |
| Emulsion D silver | 0.40 |
| ExS-7 | $8.0 \times 10^{-4}$ |
| ExY-1 | 0.030 |
| ExY-2 | 0.55 |
| ExY-3 | 0.25 |
| ExY-4 | 0.020 |
| ExC-7 | 0.01 |
| HBS-1 | 0.35 |
| Gelatin | 1.30 |
| Layer 12: (High-speed blue-sensitive emulsion layer) | |
| Emulsion F silver | 1.38 |
| ExS-7 | $3.0 \times 10^{-4}$ |
| ExY-2 | 0.10 |
| ExY-3 | 0.10 |
| HBS-1 | 0.070 |
| Gelatin | 0.86 |
| Layer 13: (First protective layer) | |
| Emulsion G silver | 0.2 |
| UV-4 | 0.11 |
| UV-5 | 0.17 |
| HBS-1 | $5.0 \times 10^{-2}$ |
| Gelatin | 1.00 |
| Layer 14: (Second protective layer) | |
| H-1 | 0.40 |
| B-1 (diameter of 1.7 μm) | $5.0 \times 10^{-2}$ |
| B-2 (diameter of 1.7 μm) | 0.10 |
| B-3 | 0.10 |
| S-1 | 0.20 |
| Gelatin | 1.20 |

Further, each layer contains W-1 to W-3, B-4 to B-6, F-1 to F-17 indicated before, iron salt, lead salt, gold salt, platinum salt, iridium salt, palladium salt and rhodium salt, which serve to enhance storage stability, processability, anti-pressure property, anti-mildew and bacteria performance, antistatic performance, and coating performance.

As described, according to the present invention, there are provided a method of storing a silver halide photographic emulsion after preparation thereof, by which the deterioration of the properties during the storage is very low, such a silver halide photographic emulsion and such a silver halide light-sensitive material.

What is claimed is:

1. A method of storing a silver halide photographic emulsion, comprising the steps of storing the emulsion in the presence of at least one antioxidizing agent added thereto and, after said storing step, subsequently adding a coupler dispersion to the stored emulsion, wherein said antioxidizing agent is at least one selected from the compounds represented by formula (A):

Formula (A)

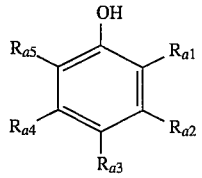

wherein $R_{a1}$, to $R_{a5}$ may be the same or different and each represents a hydrogen atom, an alkyl group, an alkenyl group, an aryl group, a heterocyclic group, an alkyloxycarbonyl group, an aryloxycarbonyl group, an acyl group, an alkylsulfonyl group, an arylsulfonyl group, a carboxyl group, a carbamoyl group, a sulfamoyl group, a halogen atom or —X—$R_{a0}$, —X— represents —O—, —S— or —N($R_{a6}$)—, $R_{a0}$ represents an alkyl group, an alkenyl group, an aryl group, a heterocyclic group, an acyl group, an alkylsulfonyl group or an arylsulfonyl group, $R_{a6}$ represents a hydrogen atom or a group defined by $R_{a0}$, and those substituents $R_{a1}$ to $R_{a5}$ which are located at an ortho-position with respect to each other may be combined to form a 5- to 7-membered ring; with the proviso that $R_{a1}$ to $R_{a5}$ must not be hydrogen atoms all at the same time, and when $R_{a3}$ is a halogen atom, —O—$R_{a0}$, or —S—$R_{a0}$, at least one of $R_{a1}$ and $R_{a5}$ is an alkyl group.

2. The method according to claim 1, wherein said emulsion is reduction-sensitized.

3. The method according to claim 2, wherein said antioxidizing agent represented by formula (A) is added to the emulsion after the emulsion is reduction-sensitized.

4. The method according to claim 1, wherein said emulsion consists of silver halide grains, at least 50% of the grains have a ratio of (100) face of 60% or more to the total face.

5. The method according to claim 1, wherein said emulsion is selenium-sensitized.

6. The method according to claim 1, wherein said emulsion is gold- and sulfur-sensitized.

7. The method according to claim 1, wherein said emulsion is gold-, sulfur- and selenium-sensitized.

8. The method according to claim 1, wherein said antioxidizing agent represented by formula (A) is present in an amount of from $1\times10^{-6}$ to $1\times10^{-2}$ moles per mole of silver halide.

9. The method according to claim 1, wherein said antioxidizing agent represented by formula (A) is present in an amount of from $1\times10^{-5}$ to $1\times10^{-3}$ moles per mole of silver halide.

10. The method according to claim 1, wherein said antioxidizing agent represented by formula (A) is added to the emulsion after being dissolved in water, alcohol, an ester, a ketone, or a solvent mixture thereof.

11. The method according to claim 2, wherein said antioxidizing agent represented by formula (A) is added to the emulsion after the emulsion is subjected to chemical sensitization.

12. The method according to claim 11, wherein said chemical sensitization is selenium sensitization.

* * * * *